US011440039B2

(12) United States Patent
Lamboux

(10) Patent No.: US 11,440,039 B2
(45) Date of Patent: Sep. 13, 2022

(54) METHOD FOR THE RE-FILLING OF A TRAVEL DISPENSER WITH PRODUCT AND TRAVEL DISPENSER

(71) Applicant: TECHNIPLAST, Louviers (FR)

(72) Inventor: Jean-Philippe Lamboux, Saint Didier des Bois (FR)

(73) Assignee: TECHNIPLAST, Louvers (FR)

( * ) Notice: Subject to any disclaimer, the term of this patent is extended or adjusted under 35 U.S.C. 154(b) by 0 days.

(21) Appl. No.: 16/986,537

(22) Filed: Aug. 6, 2020

(65) Prior Publication Data

US 2021/0283629 A1 Sep. 16, 2021

(30) Foreign Application Priority Data

Aug. 14, 2019 (FR) ..... 19 09224

(51) Int. Cl.
*B05B 11/00* (2006.01)

(52) U.S. Cl.
CPC ..... *B05B 11/0097* (2013.01); *B05B 11/0044* (2018.08); *B05B 11/306* (2013.01)

(58) Field of Classification Search
CPC ..... B05B 11/0097; B05B 11/0044; B05B 11/306; B05B 11/3024; B05B 11/3047
USPC ..... 222/147, 165, 321.9
See application file for complete search history.

(56) References Cited

U.S. PATENT DOCUMENTS 4,271,875 A * 6/1981 Meshberg ..... B05B 11/0097 141/3
4,842,495 A 6/1989 Howlett
4,917,156 A * 4/1990 Varlet ..... B05B 11/0097 141/20
6,543,653 B2 * 4/2003 Lamboux ..... B05B 11/3009 222/321.8
8,668,121 B2 * 3/2014 Lamboux ..... B67D 3/044 222/484
2011/0174840 A1 7/2011 Law et al.
2015/0284175 A1 * 10/2015 Lamboux ..... B65D 83/14 222/1

(Continued)

FOREIGN PATENT DOCUMENTS

WO 2014/085875 6/2014
WO 2014/147351 9/2014

OTHER PUBLICATIONS

International Search Report dated May 27, 2020.

*Primary Examiner* — Vishal Pancholi
(74) *Attorney, Agent, or Firm* — Ipsilon USA LLP

(57) ABSTRACT

A method is provided for the re-filling with product of a travel dispenser (10) which has two assemblies (12, 14) which are connected together mechanically for dispensing the product. A first assembly (12) includes a bottle (10) of the product, a venting passage which is able to be opened to connect the interior and the exterior of the bottle and a pump (22) mounted on the bottle which is able to assume an upper rest position in which the passage is closed and a lower position in which the passage is open. A second assembly (14) includes a product dispensing device (16). The method includes blocking of the pump (22) in the lower position, and disengagement of the two assemblies (12, 14) from one another in order to allow the bottle (10) to be re-filled with product through the open venting passage of the first assembly (12) in re-fill mode.

12 Claims, 22 Drawing Sheets

(56) References Cited

U.S. PATENT DOCUMENTS

| | | | | |
|---|---|---|---|---|
| 2017/0113237 | A1* | 4/2017 | Scott | B05B 11/0056 |
| 2018/0141066 | A1 | 5/2018 | Lamboux et al. | |

* cited by examiner

METHOD FOR THE RE-FILLING OF A TRAVEL DISPENSER WITH PRODUCT AND TRAVEL DISPENSER

RELATED APPLICATION

This application claims the benefit of priority from French Patent Application No. 19 09224, filed on Aug. 14, 2019, the entirety of which is incorporated by reference.

FIELD OF THE INVENTION

The present invention concerns a method for the re-filling with product in the form of liquid, gel or cream of a travel dispenser of said product.

DESCRIPTION OF RELATED ART

Travel dispensers, which are sometimes called "handbag packs" as their size allows them to be transported in a handbag, are known. Said travel dispensers serve in a known manner to dispense, more specifically to spray, a liquid product, for example perfume.

A known type of such a travel dispenser comprises a bottle containing perfume and, mounted on said bottle in a removable manner, for example by screwing and unscrewing, a non-removable unitary assembly which is formed by:

- a pump connected to a dip tube which extends in the interior of the bottle, the pump being able to assume, on the one hand, an upper rest position in which a venting passage between the interior and the exterior of the dispenser is closed and, on the other hand, a lower position in which the venting passage is open,
- a push block which comprises a device for spraying perfume to the outside of the travel dispenser and which, under the effect of an external vertical push on the part of the user, is able to actuate the pump in the lower position so as to allow the perfume in the bottle to flow to the spraying device, the venting passage opening during the actuation of the pump.

When said type of dispenser is empty, it is necessary, to be able to use it again, to re-fill it with perfume. To do this, the aforesaid unitary assembly has to be removed, for example by unscrewing, from the bottle so as to separate the two elements. Then said bottle has to be re-filled with a bottle serving as a reservoir, also called a source bottle, and which generally has a large capacity. The source bottle obviously needs to be able to be easily opened so that perfume can be poured into the interior of the bottle to be re-filled. The source bottle is generally a bottle of the type with a stopper.

During said re-filling operation, the perfume is in contact with the air when it is poured from the source bottle into the bottle to be re-filled and it can oxidize, thus leading to a possible deterioration in the product.

Moreover, during said re-filling operation, it is not unusual to pour perfume down the side of the bottle to be re-filled and over its external wall, which requires it to be wiped before it can be used or put away. When wiping the bottle to be re-filled, the user must be careful not to knock over the source bottle. In addition, product, quite often very expensive, is wasted during said operation.

Furthermore, once the re-filling operation is finished, the user has two open bottles in front of him and he must therefore take precautions when he recloses the first bottle, whichever it is, so as not to knock over the second bottle.

Document WO2005/101969 also discloses a system for re-filling a bottle in which the bottle is provided, on the one hand, at its upper end with a spraying device mounted on a pump connected to a dip tube which extends inside the bottle and, on the other hand, at its opposite lower end with a specific bottom provided with a valve system which is spring-loaded in order to allow, when the valve system is actuated (spring compressed) by the rod of a source bottle containing perfume, said bottle to be re-filled through its bottom.

However, said solution has the disadvantage of requiring a specific bottle for its implementation since conventional bottles do not have a bottom provided with a valve system. Said solution is therefore complicated and expensive to implement and cannot be accommodated on conventional bottles.

OBJECTS AND SUMMARY

In the light of the above, it would therefore be very useful to be able to re-fill a bottle of a perfume travel dispenser, or in a general manner of a travel dispenser of a product in the form of liquid, gel or cream, without having at least one of the aforesaid disadvantages.

The object of the present invention is thus a method for the re-filling with product in the form of liquid, gel or cream of a travel dispenser of said product, the travel dispenser comprising two assemblies which are connected together mechanically for dispensing the product in dispensing mode:

- a first assembly including a bottle containing the product, a venting passage which is able to be opened to connect the interior and the exterior of the bottle and a pump mounted on the bottle which is able to assume, on the one hand, an upper rest position in which the venting passage is closed and, on the other hand, a lower position in which the venting passage is open, the upper and lower positions being considered when the pump is arranged in the upper part of the bottle,
- a second assembly including a device for dispensing product to the outside of the dispenser, characterized in that the method comprises the following stages:

blocking of the pump in the lower position, disengagement of the two assemblies one from the other in order to allow the bottle to be re-filled with product through the open venting passage of the first assembly in re-fill mode.

The new design of said travel dispenser allows the constituent elements of the dispenser to be separated/disengaged in a different manner from the prior art into two distinct assemblies and the pump of one of the two assemblies to be blocked in a lower position with the venting passage open so as to be ready for a re-filling operation which will take place through the venting passage (the method as shown above can be seen as a method for positioning a travel dispenser in re-filling mode). The pump therefore has no need to be separated from the bottle in order to allow re-filling. The bottom of the bottle, which is arranged at the opposite end of said bottle, is not used to re-fill the bottle as in one of the known techniques presented above. The bottle of the dispenser does not therefore need to be opened, which avoids oxidation of the product, the risks of losing product and of contaminating the bottle to be re-filled as well as the surface used for the re-filling operation. The number of operations necessary to place the dispenser in the re-filling position is also reduced. The operations covered by the above method and which are to be carried out by a user are particularly simple to realize. Moreover, the bottle to be re-filled can be of the conventional type and, in particular, has no need therefore to have a non-conventional bottom. It should be noted that the pump is generally of the type including an upper valve and a lower valve (when the pump is arranged in the upper part of the bottle, that is to say when the dispenser is in the vertical position in dispensing mode). The lower position of the pump which is mentioned above corresponds to a position of the pump (so-called pre-fill position or pre-re-fill position) in which the venting passage is open and, when the pump is turned upside down, (when the first assembly which bears the pump is turned upside down), the upper and lower valves of the pump are open either due to gravity or due to the increase in pressure in the bottle when the re-fill product is introduced. The opening of said valves (due to gravity or to an increase in pressure in the bottle) allows, during the re-filling operation, the re-fill product, such as liquid, to be introduced through the venting passage, whilst the air present in the bottle is expelled to the outside of the bottle through the open valves of the pump as the volume of the product is introduced into the bottle. The valves can adopt any appropriate configuration.

According to other possible characteristics:

the second assembly includes an actuating device which, in dispensing mode, is able, under the effect of an external action, to actuate the pump in the lower position and to open the venting passage so as to allow the product to flow from the bottle to the dispensing device;

the actuating device is a push block which is able to receive an external push;

the method includes more specifically the following stages:

actuation of the actuating device to actuate the pump in the lower position, actuation of a dispenser blocking mechanism in order to block the pump when in the lower position, separation of the first assembly and of the second assembly;

the method further includes the following stages:

turning the first assembly upside down, the venting passage of which is open and the pump is blocked in the lower position, positioning said first assembly on a pump of a source bottle containing product so as to connect the venting passage of the first assembly mechanically to said pump of the source bottle (for example by means of a re-filling interface), actuating the pump of the source bottle so product flows from said source bottle to the bottle to be re-filled through the open venting passage; the actuating of the pump of the source bottle can be effected by realizing at least one push on the first upside down assembly (one push being able to suffice when one dose of product from the source bottle pump is sufficient to fill the bottle to be re-filled), perhaps successive pushes so as to actuate the pump of the source bottle gradually when the dose dispensed by the same is not sufficient in itself to re-fill the bottle to be re-filled;

the pump is able to assume several successive lower positions, in each of which the venting passage is open.

The object of the invention is also a travel dispenser comprising two assemblies which are connected together mechanically for dispensing product in dispensing mode:

a first assembly including a bottle containing product, a venting passage which is able to be opened in order to connect the interior and the exterior of the bottle and a pump mounted on the bottle which is able to assume, on the one hand, an upper rest position in which the venting passage is closed and, on the other hand, a lower position in which the venting passage is open, the upper and lower positions being considered when the pump is arranged in the upper part of the bottle, a second assembly including a device for dispensing product to the outside of the dispenser, characterized in that the travel dispenser further comprises:

a first mechanism for blocking the pump which is able to be actuated under an external action of a user when the pump is actuated in the lower position, a second mechanism which is configured in order, under an external action of a user, to displace the two assemblies one with respect to the other from a first position, in which the two assemblies are axially connected, to a second position in which the two assemblies are able to be moved apart axially from one another.

The travel dispenser has the same advantages as the method briefly described above and they will therefore not be repeated here. Said dispenser simply needs to arrange, in the first assembly, in its part situated outside the bottle, as well as in the second assembly, mechanisms for blocking the pump in the lower position and for allowing the two assemblies to be separated mechanically when the user wishes to re-fill the bottle which is empty or almost empty. The pump and the bottle do not need to be modified. Said mechanisms require the user to carry out very simple actions such as a rotation or rotations and/or a translation or translations of one assembly (or of one part of an assembly) with respect to the other one.

According to other possible characteristics:

each mechanism comprises one or multiple blocking members which are each able to cooperate with at least one corresponding stop element in the blocking position, the blocking member or members and said at least one corresponding stop element being able to be displaced in a relative movement (e.g. rotation) with respect to one another under an external action of a user (rotation and/or translation), both for attaining the blocking position and for attaining a release position; the design of the mechanisms can thus be simple and efficient and their implementation by a user is particularly simple;

the blocking member or members and said at least one corresponding stop element are different for the two mechanisms;

the blocking member or members and said at least one corresponding stop element comprise at least one member and at least one corresponding cam track with respect to which said at least one member is able to be moved or the other way round; said type of mechanism is particularly simple and efficient and, according to the design, the one or the other of the constituent elements of said mechanism is mobile whilst the other one is fixed;

the first assembly includes, on the one hand, a part connected axially and rotatably to the pump and, on the other hand, at least one part, one of the two parts defining a cam track for at least one member of the other part, one of the two parts being connected temporarily to the second assembly so that, following a rotational movement of the second assembly with respect to the first assembly by means of the external action of a user, said at least one member is displaced in a portion of the corresponding cam track which is configured to prevent the pump returning axially into an upper position;

the first assembly and the second assembly are able to turn upside down with respect to one another and include two parts, one of which is configured to form at least one cam track that is closed at a first end and open axially at a second opposite end and the other part is configured in order to bear at least one member, said at least one member and said at least one cam track being able to be displaced following a relative rotational movement of one part with respect to the other, said at least one cam track being configured so that, under the action of a relative rotational movement provided by a user according to a predetermined angular range, said at least one member is disposed facing the second opposite open end axially of the corresponding cam track, allowing, under the action of an axial translation applied by the user, said at least one member to exit from said corresponding cam track and consequently to move the two assemblies apart axially from one another.

BRIEF DESCRIPTION OF THE DRAWINGS

Other characteristics and advantages will appear during the reading of the following description which is given solely by way of non-limiting examples and is made with reference to the accompanying drawings, in which.

All

DETAILED DESCRIPTION

An embodiment of a product travel dispenser according to the invention as well as an embodiment of a method according to the invention for the re-filling of such a travel dispenser with product are shown in the Figures accompanying the present description and will be described below. Other embodiments of the travel dispenser and of the re-filling method are obviously conceivable within the framework of the invention.

According to an embodiment of the invention, the travel dispenser allows a product in the form of a liquid, gel or cream to be dispensed and it comprises, to this end, a device dispensing product to the outside of the dispenser which is adapted to the product to be dispensed. In particular, when a perfume is dispensed by being sprayed outside the dispenser, the dispensing device is a spray.

Generally speaking, the travel dispenser takes up a relatively reduced amount of space since, as indicated by its name, it is intended to be moved around by a user and notably to be transported, for example, inside a travel bag, a suitcase or a handbag. The travel dispenser must therefore be neither too bulky nor too heavy so that it can be easily transported. As it takes up a small amount of space, its product capacity is therefore limited and it is therefore intended to be re-filled repeatedly over time. To this end, it is therefore particularly useful to be able to re-fill the dispenser in a simple and reliable manner, without ever deteriorating the product during the re-filling operations.

In a general manner, the travel dispenser comprises two assemblies which are connected together mechanically when the dispenser is able to operate in product dispensing mode. The dispenser is in said mode, for example, when it is transported by the user and also when it is about to be used, is being used by said latter or prior to being transformed so that it can be placed into another mode, called the re-filling mode. The travel dispenser is in said other mode of use when the user wishes to put product back into the interior of the dispenser (re-filling). To be positioned in said second mode, the two assemblies have to be disengaged/separated mechanically from one another.

Figure 1:
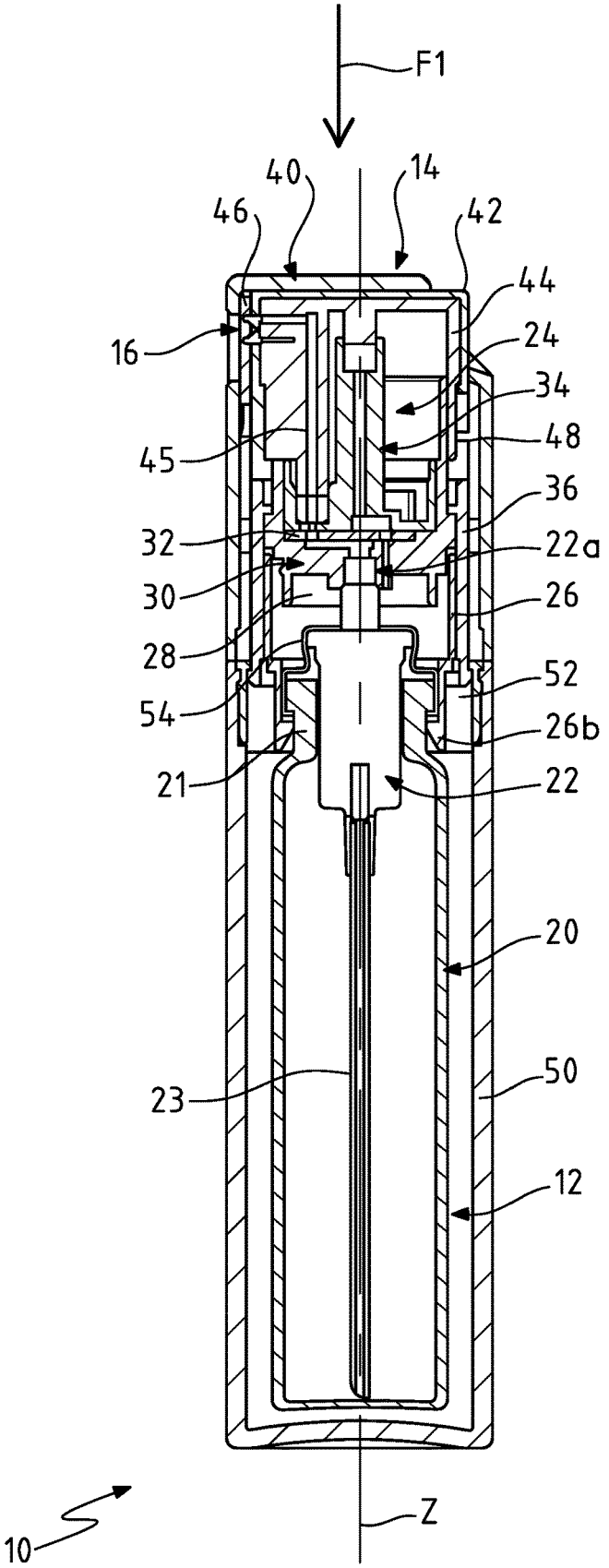
FIG. 1 is a schematic representation of a longitudinal section of a product travel dispenser according to an embodiment of the invention.

More specifically, the dispenser 10 in FIG. 1 comprises a first assembly 12, here called a lower assembly (when the dispenser is in the vertical position and placed on a planar surface), which is connected mechanically to a second assembly 14, so-called upper assembly, forming a cover and which, in a general manner, includes the device 16 for dispensing product already mentioned above and a device for actuating the dispenser (for example a push block). The elements composing the dispenser are shown in a very schematic manner in FIG. 1 and supplementary details can be seen in the other Figures and notably in the exploded view in FIG. 2. Implementation details which appear in FIG. 3 and in following Figures do not necessarily correspond with the details appearing in FIG. 1. However, this in no way modifies the explanations nor the principle of the invention.

The first assembly 12 comprises:

- a bottle 20 which contains product which is intended to be dispensed to the outside of the dispenser,
- a venting passage (not shown in FIG. 1) which is able to be opened in order to connect the interior with the exterior of the bottle and thus to compensate for the vacuum caused by the dispensing of a volume of product to the outside of the bottle,
- a pump 22 which is mounted on the bottle 20 (in an inseparable or separable manner) and which is able to assume, on the one hand, a so-called resting upper position in which the venting passage is closed (the dispenser cannot be used with the pump in such a position) and, on the other hand, a lower position in which the venting passage is open (it should be noted that the pump can assume several successive lower positions, each one obtained by implementing the above-mentioned actuating device, and in each of which the venting passage is open).

The pump 22 is arranged in the upper part of the bottle 20 (the pump is engaged in the opening of the bottle 20, the opening opposite the bottom, and is in part in the bottle and outside the same) when the dispenser is in the vertical or essentially vertical position, ready to be used in dispensing mode, as is the case in FIG. 1. The venting passage is generally limited to the interior of the first assembly 12 and takes the form of an internal passage arranged between the pump and the bottle. As the pump is axially mobile (vertically in FIG. 1), the configuration of the internal passage develops as a function of the axial position of the pump inside the bottle. This is the way said internal passage is closed when the pump is in the upper position, thus preventing the outside air from penetrating inside the bottle. In contrast, when the pump is in a lower position, the outside air can penetrate into the interior of the bottle through the open venting passage between the pump and the inside of said bottle. Said passage can be seen notably in FIGS. 3 and 4.

It should be noted that the pump and the bottle are standard/conventional components available on the market. This means that the dispenser 10 can be realized without having to call the design of the pump and of the bottle into question, which is very advantageous compared to existing solutions which can necessitate having a specific bottle and/or pump.

The lower part of the pump 22 is connected to a dip tube 23 which extends towards the bottom of the bottle and communicates with the lower part of the bottle in order to draw product from there. The pump is, for example, of the known type and, to this end, includes a pumping system with two internal valves, that is to say an upper valve and a lower valve. In dispensing mode, when the pump is primed and notably at the end position of the pump (lowest position), the upper valve is open whilst the lower valve is closed in said pump configuration. When the push is made, the upper valve is closed and the lower valve opened. In re-filling mode, when the pump is in the upturned position, the two valves are opened either by gravity or according to the increase in pressure in the bottle when the re-filling product is introduced. The lower position of the pump that has to be obtained by actuating said pump in order then to be able to proceed with re-filling the bottle is a lower or pressed position of the pump for which the venting passage is open and for which, with the pump in the upturned position, the two upper and lower valves are open or are able to be opened with the internal pressure in the bottle. The valves do not necessarily have the configuration shown in the Figures. Said lower position can be referred to as the lower pre-re-fill position. Later in the description, when it is a question of the lower position of the pump, it must be understood that it is a question of the pre-re-fill lower position unless otherwise agreed.

The first assembly 12 also includes in said embodiment a re-filling interface 24 which is mounted above the pump 22 and the bottle (FIG. 1), and more specifically between the actuating device of the second assembly 14 and the pump. The re-filling interface 24 includes an internal path to allow, in re-filling mode, the re-fill product to flow from an external zone or part of the interface where the product is situated to the entry of the above-described venting passage between the pump and the bottle. As will be seen subsequently, said internal path is blocked/closed by a blocking member when the dispenser is in dispensing mode and it is only opened under the pressure of the re-filling fluid when the dispenser is in re-filling mode.

With the travel dispenser in dispensing mode (FIGS. 1 and 2), the second upper assembly 14 is configured to allow, under the effect of an external action (action which is generally exerted by the finger of a user exerting vertical pressure downward F1 onto the actuating device), the pump 22 of the first assembly 12 to be actuated in the lower position (according to the push exerted by the user, the axial/vertical position of the pump can be more or less lower) and the venting passage of said assembly to be opened so as to allow the product to flow from the bottle to the dispensing device 16.

Components involved in the formation of an embodiment of a dispenser according to the invention will now be described with reference to FIGS. 1 to 3.

Figure 2:
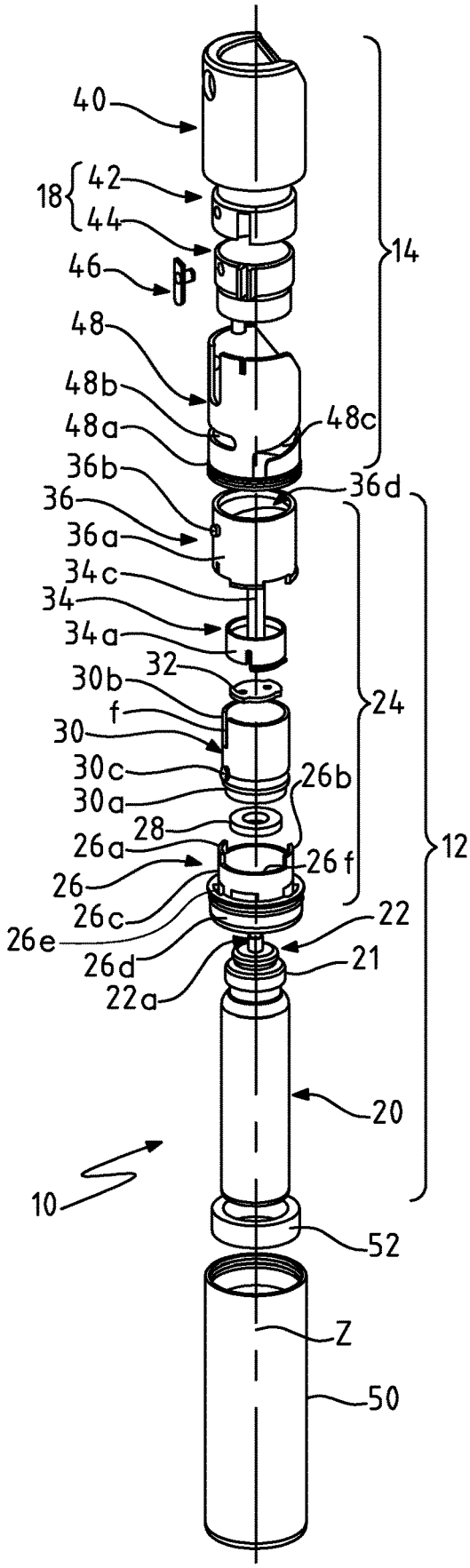
FIG. 2 is a schematic representation of an exploded view of different components of the dispenser of FIG. 1.
Figure 3:
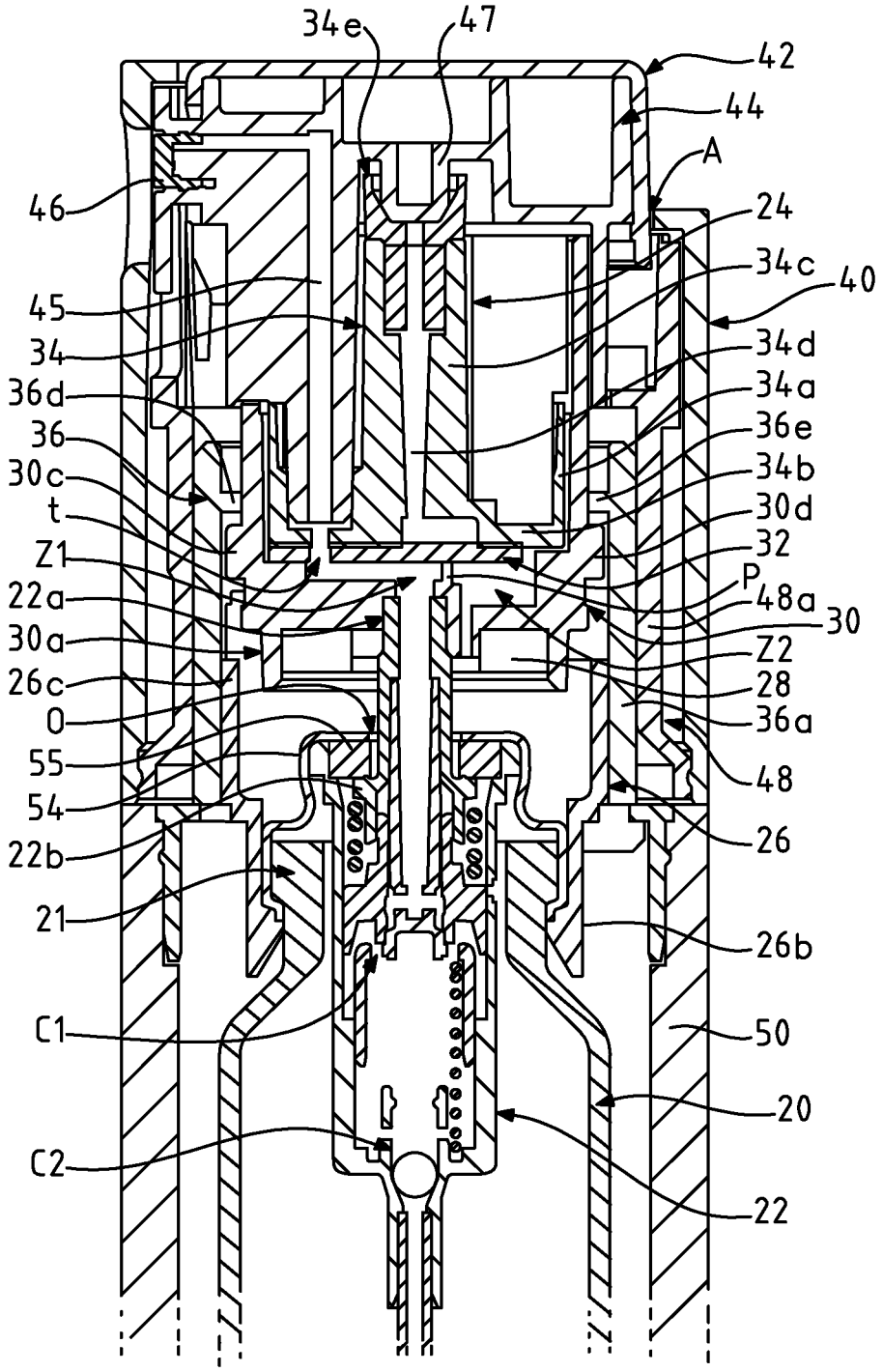
FIG. 3 is a schematic representation of an enlarged partial view of the dispenser of FIG. 1.

The re-filling interface 24 of the first assembly 12 can comprise more specifically the following elements that are engaged/assembled together in the manner of an axial stack (following the longitudinal axis of the bottle which, in FIGS. 1 and 2, corresponds to the vertical axis Z), starting from the stack element situated the lowest in FIG. 2:

- a lower cam 26 intended to be positioned and fixed around the neck of the bottle 20, thus surrounding the pump 22; the lower cam 26 includes one or several stops (for example in the form of slots) of which there are two here, 26*a-b*, diametrically opposed and arranged on a circumference of an upper edge of an essentially cylindrical wall 26*c* of the cam 26 (one single stop can suffice); the lower cam also includes, below the essentially cylindrical wall 26*c*, a radially widened bottom 26*d* which includes an annular external rim 26*e;*
- a flat seal 28 with a diameter less than that of the cam 26 and which is drilled in its central part so as to be able to be positioned around the upper portion 22*a* of the pump 22 emerging from the bottle;
- a transfer part 30 including a lower part 30*a* open axially downward to receive the seal 28 and which includes dimensions smaller than those of the lower cam 26 so as to be able to engage at least in part in the internal volume defined by said cam and to rest against the latter (FIGS. 2 and 3); the transfer part 30 also includes an upper part 30*b* which extends axially above the lower cam when the part 30 is partially engaged in said lower cam, and which defines an internal, axial, upwardly open housing to receive all or part of the assembly elements arranged above in the representation in FIG. 2; the transfer part 30 also has a slit f open axially in said upper part 30*b*, which allows the transfer part, cooperating with an element protruding from the second assembly 14 engaged in said slit, to be rotatably connected temporarily to the second assembly 14; the transfer part 30 is drilled in its central part in order to be traversed from below by the portion 22*a* emerging from the pump and thus to allow the liquid extracted to flow from the bottle to the dispensing device 16; the transfer part 30 further includes two blocking members/protruding elements such as lugs 30*c-d* arranged in a diametrically opposed manner on its external surface and which extend radially away from the same (a single lug 30*c* is shown in FIG. 2) so as to be positioned vertically to the upper edge 26*f* of the wall 26*c* of the lower cam (FIGS. 1 and 3); the presence of two diametrically opposed lugs allows the stresses exerted on the structure of the dispenser to be distributed;

a transfer seal 32 which provides a sealing and separating function for the fluid paths as will be seen at a later stage and a part of which plays the role of the member blocking the re-filling interface 24; the seal is arranged at the bottom of the internal axial housing of the transfer part 30, above the emerging portion 22*a*, and is drilled with at least one through orifice so that the liquid can flow to the dispensing device (FIGS. 1 and 3);

a part forming connector 34 which comes to be positioned in the internal axial housing of the transfer part 30, above the transfer seal 32 and in contact with said latter; the part 34 includes a hollow, essentially cylindrical base 34*a* that is upwardly open axially and which has a bottom 34*b* (FIG. 3) closing the lower part of said base, the bottom being drilled at several places in its thickness, corresponding to the through orifice or orifices of the transfer seal 32 arranged below, for the passage of the product in dispensing mode and also in re-filling mode; the part 34 also includes a central vent 34*c* which extends axially from the bottom 34*b* to the top, and which is hollow so as to include a channel 34*d* (FIG. 3) forming a portion of the internal path of the interface 24 for the flowing of the re-fill product; as shown in FIG. 3, the vent 34*c* can be topped by a part 34*e* which is inserted in part in the interior of the vent and has a flared shape (in the form of a funnel) in its external part; said part, as an option, is more specifically used as a connection part during the re-filling operation;

an upper cam 36 which surrounds the transfer part 30 in its upper part when the elements are assembled together and which comes, through its lower part, to abut against the external rim 26*e* of the lower cam 26 and into contact with the wall 26*c* that it surrounds; the upper cam 36 has a general, essentially cylindrical shape delimited by an external wall 36*a*, provided on its external surface, for example, with two blocking members/protruding elements such as diametrically opposed lugs 36*b-c* which extend radially away from the surface (a single lug 36*b* is shown in FIG. 2; according to a variant one single lug can suffice and is arranged, for example, essentially vertically with respect to the nozzle 46 of the second assembly 14 so as to facilitate identification for the user); the upper cam 36 is generally speaking hollow, open axially at its two opposite ends and is arranged in the assembly in FIGS. 1 and 3 so as to surround and to be in contact with the transfer part 30.

The second assembly 14 can comprise, more specifically, the following elements engaged/assembled together in the manner of an axial stack, starting with the element of the stack situated the highest in FIG. 2:

a cover or collar 40 forming an axial extension external casing for the second assembly, which is open in its upper part and on one of its sides (according to an inclined facet) and which is drilled radially by a through opening in the casing for dispensing product to the outside of the dispenser;

a part 42 forming an over-push-piece, for example in the form of a cap, which is intended to be accommodated in the upper part of the collar and which is also drilled with a through opening in its peripheral wall, corresponding with the through opening in the collar 40 when the over-push-piece is inserted inside the same;

a part 44 forming a push-piece which forms a part of the product dispensing device 16 already mentioned above and which includes an internal channel 45 (FIG. 1) for the flow of liquid to the nozzle 46 mounted in an applied manner (for example plugged) on the external surface of the push-piece 44; the push-piece 44 includes in its upper part an axial protrusion 47 (FIG. 3) pointing downward so as to be inserted in the flared external part 34*e* of the part 34 and to block the internal path 34*d* when the second assembly 14 is still engaged/assembled to/with the first assembly 12 of the dispenser; the push-piece 44 comprises a protruding element arranged below the nozzle 46 and which takes, for example, the form of a rib or a pin, said protruding element being engaged in the open axial slit f of the above-described transfer piece 30 so as to entrain said latter in a rotatable manner; the over-push-piece 42 caps the push-piece 44 when the elements are assembled/interlocked together as shown in FIGS. 1 and 3;

a part 48, called a collar insert, encompasses in part the push-piece 44 and over push-piece 42 which are interlocked together and is inserted inside the collar 40; the collar insert 48 has a general broadly cylindrical form that is open in its upper part and on the side according to an inclined facet corresponding to that of the collar 40; the collar insert 48 is mounted in the assembly so as to extend from the lower cam 26 and go upward to surround the upper cam 36 (FIG. 1); the collar insert has an essentially cylindrical wall 48*a* in which are two through-grooves 48*b* and 48*c*, each forming a cam track for one of the blocking members/lugs 36*b* and 36*c* of the upper cam 36 (said cam tracks form corresponding stop elements for the blocking members of the upper cam 36 according to the relative arrangement of the cam tracks with respect to the blocking members); each groove extends, according to a view in cross section, over an angular sector smaller than that of the semi-circumference of the cylinder and cooperates with the corresponding lug.

The aforesaid elements 42 and 44 together form a push block which constitutes a device 18 for actuating the dispenser 10 and includes the dispensing device.

As shown in FIGS. 1 to 3, the dispenser 10 includes a lower external casing or barrel 50 in which the bottle 20 is accommodated and which forms, together with the upper external casing 40 of the second assembly 14, the external shell of the travel dispenser 10. It should be noted that the barrel 50 can be part of the first assembly 12 described above.

The dispenser can include an element 52 in an absorbent material, such as an absorbent felt, which has a general annular form which is arranged around the lower part 26*b* of the lower cam enclosing the neck 21 of the bottle. Thus, the element 52 is placed between said lower part 26*b* and the internal face of the barrel 50 when the dispenser is assembled as shown in FIGS. 1 and 3. Different details of implementation may appear in the Figures and will not be described as they are not necessary to the understanding of the invention.

Furthermore, a protective cap 54 (FIG. 3), known per se, is mounted, for example, by crimping, around the neck 21 of the bottle and the protruding portion 22*a* of the pump emerging from the neck so as to define an opening O that said portion of the pump traverses to leave the bottle. Said opening O is, in a manner of speaking, an opening of the bottle since it allows access to the interior of said bottle when the cap is in place. An annular part 55 is arranged against the internal face of the cap and bounds the opening O of said cap on the outside. Said part 55 provides support to a part (for example a shoulder 22*b*) of the pump when said pump is in the upper position and allows, cooperating with said pump, the venting passage, which originates behind the opening O of the cap, to be blocked in the interior of said cap.

An embodiment of a method for re-filling the dispenser 10 with product will now be described with reference to FIG. 3 and the following Figures.

More specifically, a method for positioning the dispenser in re-filling mode is illustrated by the principle successive stages/operations in FIGS. 5A to 5E which lead to the disengagement of the two assemblies 12 and 14 from the dispenser. FIGS. 5F and 5G illustrate, on the other hand, the following stages/operations of the re-filling of the bottle of the dispenser.

Figure 5A:
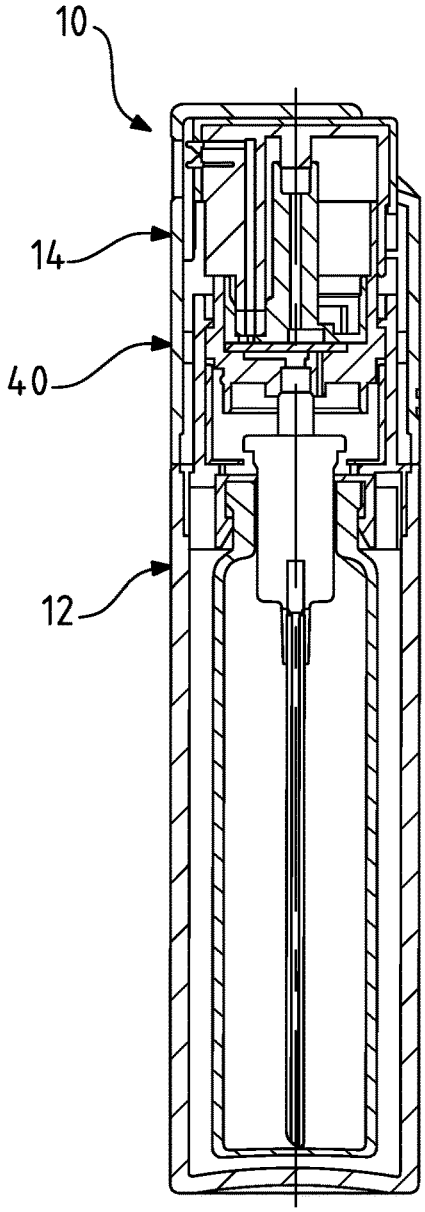
FIGS. 5A to 5E illustrate a sequence of operations for disengaging the first and second assemblies of the dispenser of FIGS. 1 and 2.

FIG. 5A illustrates an optional position of the dispenser in which the dispenser is in a blocked/locked position: actuation of the pump is not possible. Said position is made possible by the presence of a mechanism which blocks the actuation of the pump, which is now going to be described with reference to FIGS. 6A-C which are enlarged partial views of the upper part of the dispenser.

Figure 6A:
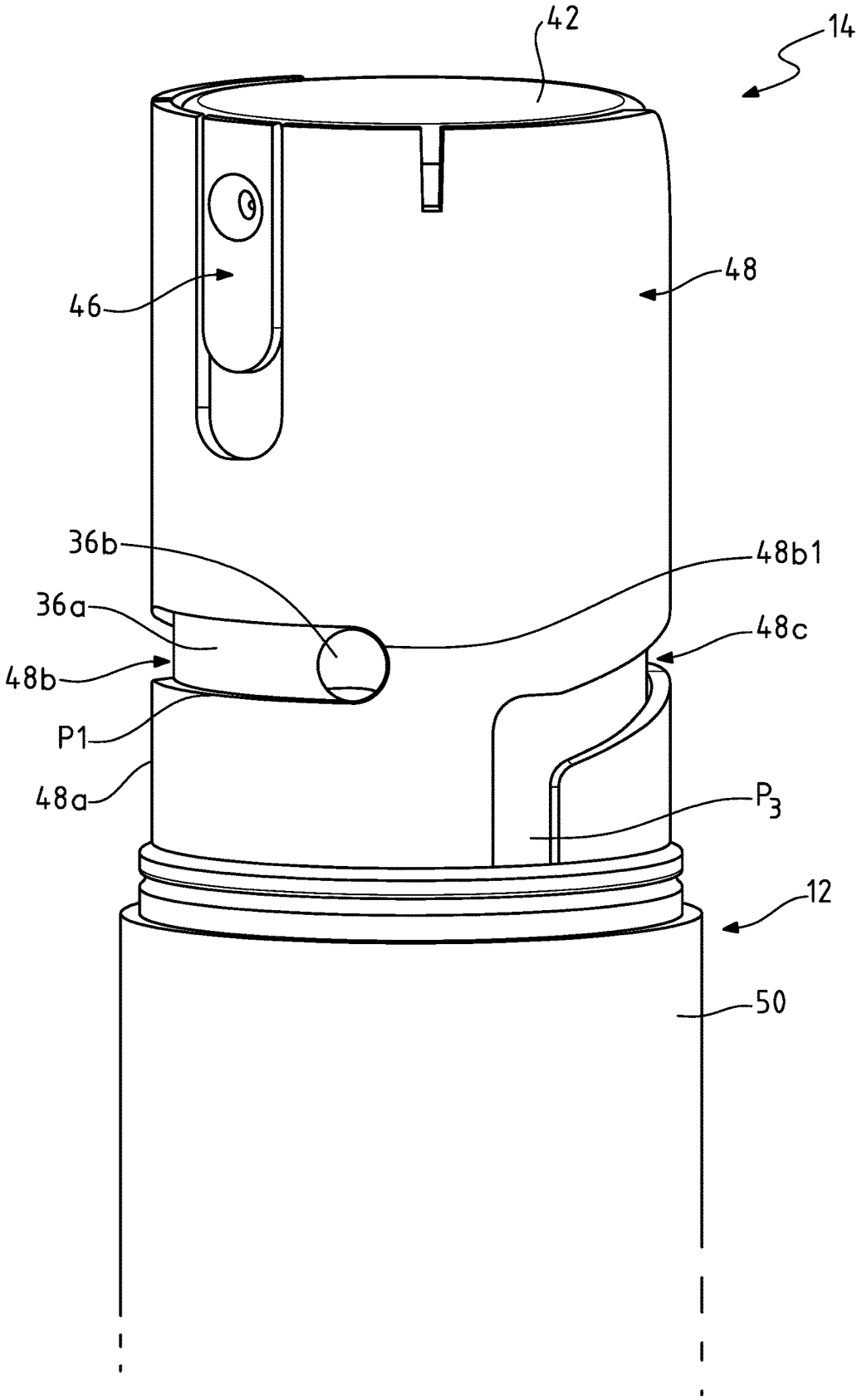
FIG. 6A is a schematic representation of an enlarged partial view of the upper part of the dispenser, without the collar 40 of FIGS. 1 and 2, with the dispenser in a position which corresponds to the position in FIG. 5A.
Figure 6B:
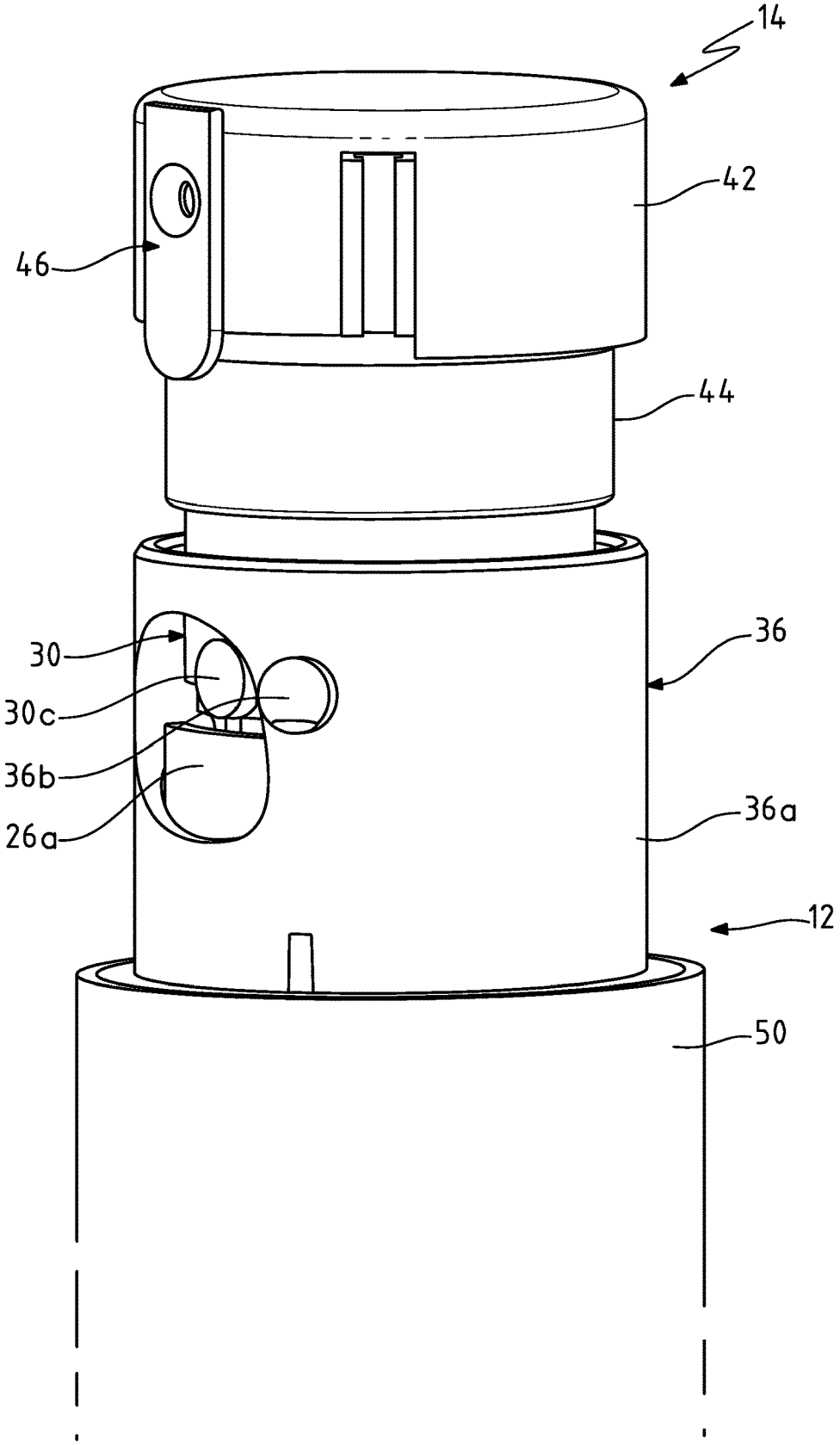
FIG. 6B shows the dispenser in the same position as in FIG. 6A, without the collar insert 48 and with a portion removed showing in a transparent manner the transfer part 30 behind the upper cam 36.
Figure 6C:
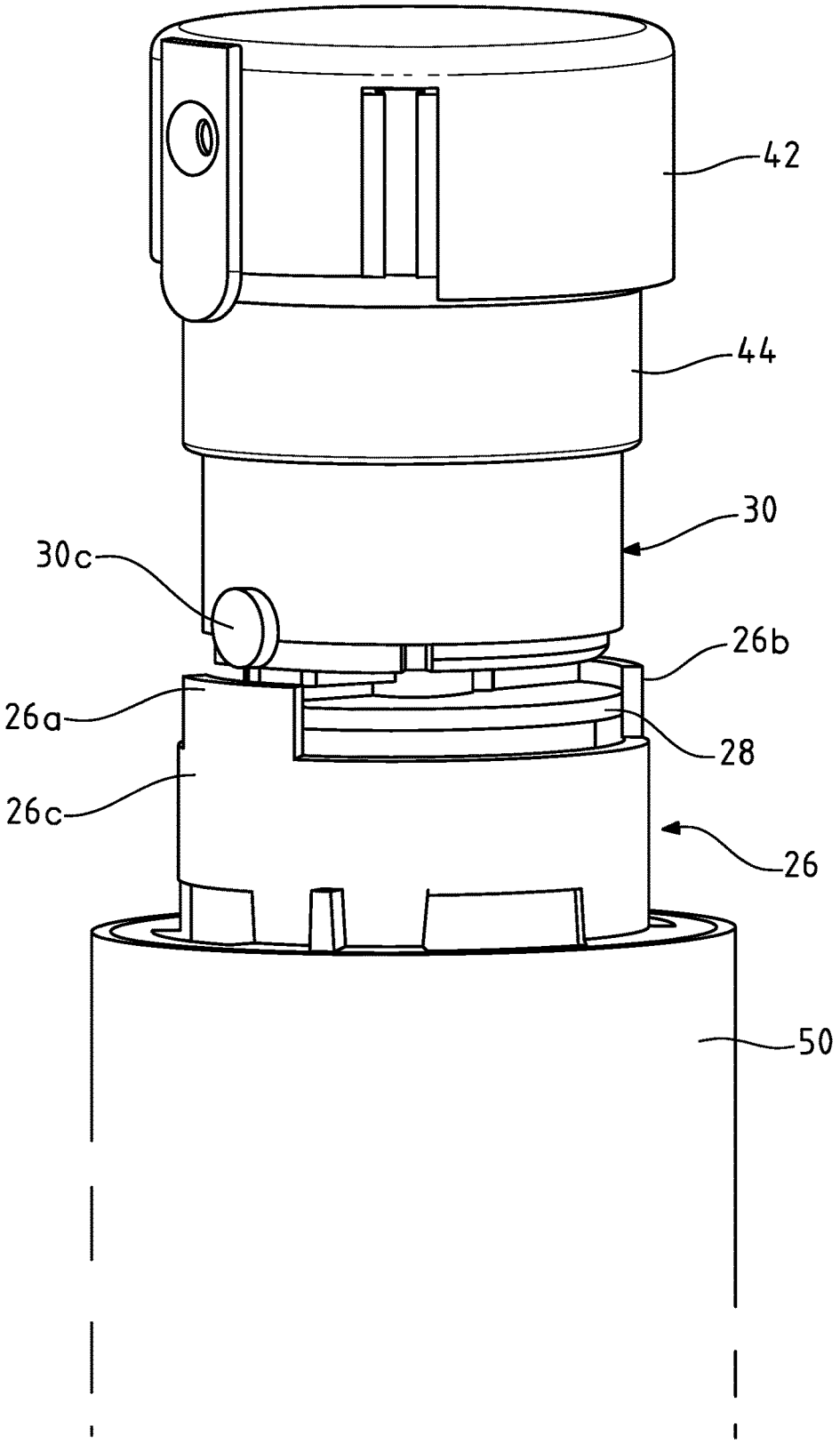
FIG. 6C shows the dispenser in the same position as in FIG. 6B but without the upper cam 36 so as to highlight the lower cam 26 and the position of the member 30*c* of the transfer part 30 above an axial stop 26*a;*

So as to understand said blocking mechanism better:

in FIG. 6A, the collar 40 in FIGS. 1 to 3 and 5A has been removed for the sake of clarity of explanation;

in FIG. 6B, the collar insert 48 has also been removed and a fictitious hole has been made in the upper cam 36 so as to show in a transparent manner the position of the lug 30*c* of the transfer part 30 (surrounded by the upper cam 36) above the axial stop 26*a* of the lower cam 26;

in FIG. 6C the upper cam 36 has been removed so as to show clearly the positioning of the transfer part 30 above the lower cam 26.

As shown in said Figures, the lugs 36*b* and 30*c* are both in abutment in the position in FIG. 5A:

the lug 36*b* is in abutment against the bottom 48*b*1 of the continuous groove forming the cam track 48*b* (FIG. 6A) and it is the same with the lug 36*c* (not visible here) in the cam track 48*c*, thus preventing the upper cam 36 performing an anticlockwise rotation; as the lugs abut against the lower edge of the corresponding cam track, they also prevent vertical descent of the upper cam (axial stop); said arrangement allows the collar insert 48 of the second assembly to be connected mechanically to the upper cam 36 of the first assembly and to assure there is rotational blocking of the one with respect to the other in one direction of rotation as well as axial blocking of the one with respect to the other; it should be noted that rotation in the opposite direction (clockwise), on the other hand, is possible as will be seen below;

the lug 30*c*, if the push-part is pressed vertically, comes to abut axially against the stop 26*a* (FIGS. 6B-C) and the same applies to the symmetrical lug 30*d* with the stop 26*b*.

As the lug 30*c* is connected to a part 30 which is in positive contact with or is connected itself to the device actuating the dispenser, the pump cannot therefore be actuated in vertical translation. The lug 30*c* and its stop therefore form the mechanism blocking the actuation of the pump. Other rotational blocking and axial blocking mechanisms between the parts connected to the two assemblies can be used in an alternative manner.

More specifically, as illustrated in FIG. 6A, the cam track 48*b* (the following description applies equally to the cam track 48*c* which cooperates with the lug 36*c*) extends first of all from the bottom 48*b*1 which forms a closed end of the groove, over a first portion P1 of the length or of the circumference of the cam track which corresponds to a first angular sector. Said first portion P1 extends horizontally, therefore at a same axial or altitude position (position which is defined along the vertical axis of the assembly/stack of different elements in FIGS. 1 and 6A). When the lug 36*b* is moved over said portion of the cam track (being guided by the latter), it keeps the same axial or altitude position relatively to the axis of the dispenser. The cam track 48*b* then extends over a second portion P2, inclined along its length (visible in FIG. 6H) which corresponds to a second angular sector and shifts progressively downward so as to lower/reduce the axial or altitude position of the groove until reaching, at the opposite end of the groove, a vertical portion P3 of the groove which allows the lug 36*b* (and the lug 36*c* in the vertical portion of the groove of the corresponding cam track 48*c*) to be axially disengaged and thus the collar insert 48, which is then ready to be withdrawn (withdrawal of the second assembly 14), to be axially released.

Figure 5B:
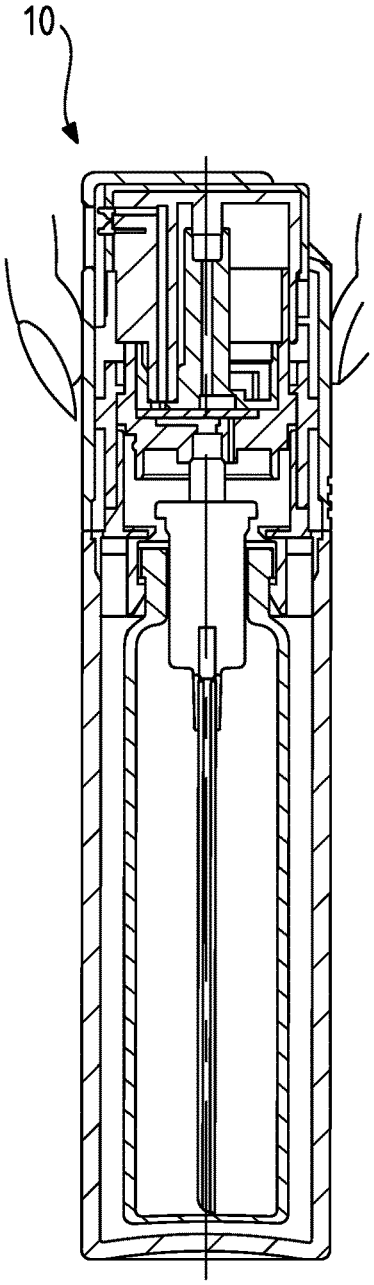
Figure 6D:
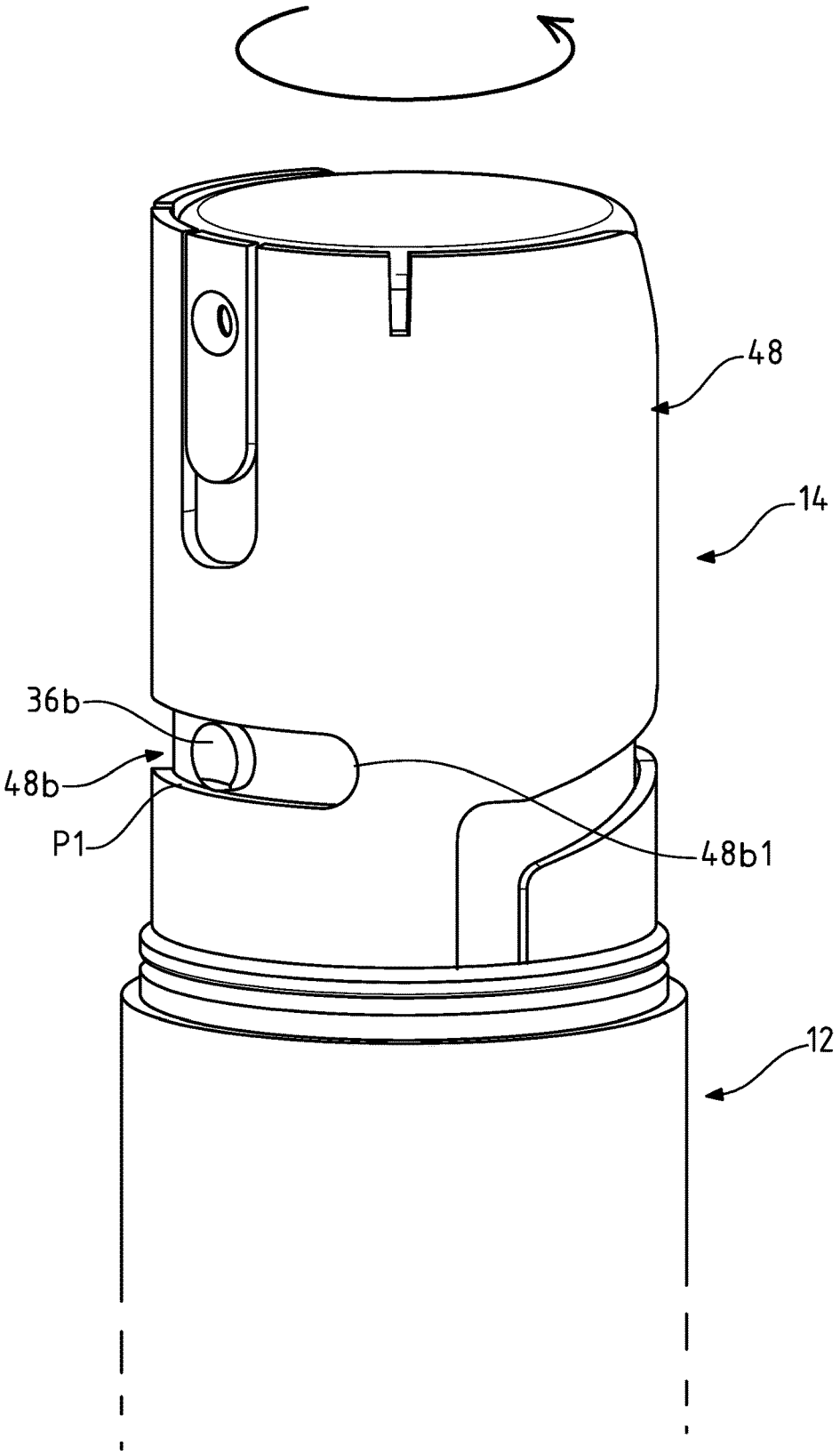
FIG. 6D is a view analogous to that in FIG. 6A, with the dispenser in a position which corresponds to the position in FIG. 5B.
Figure 6E:
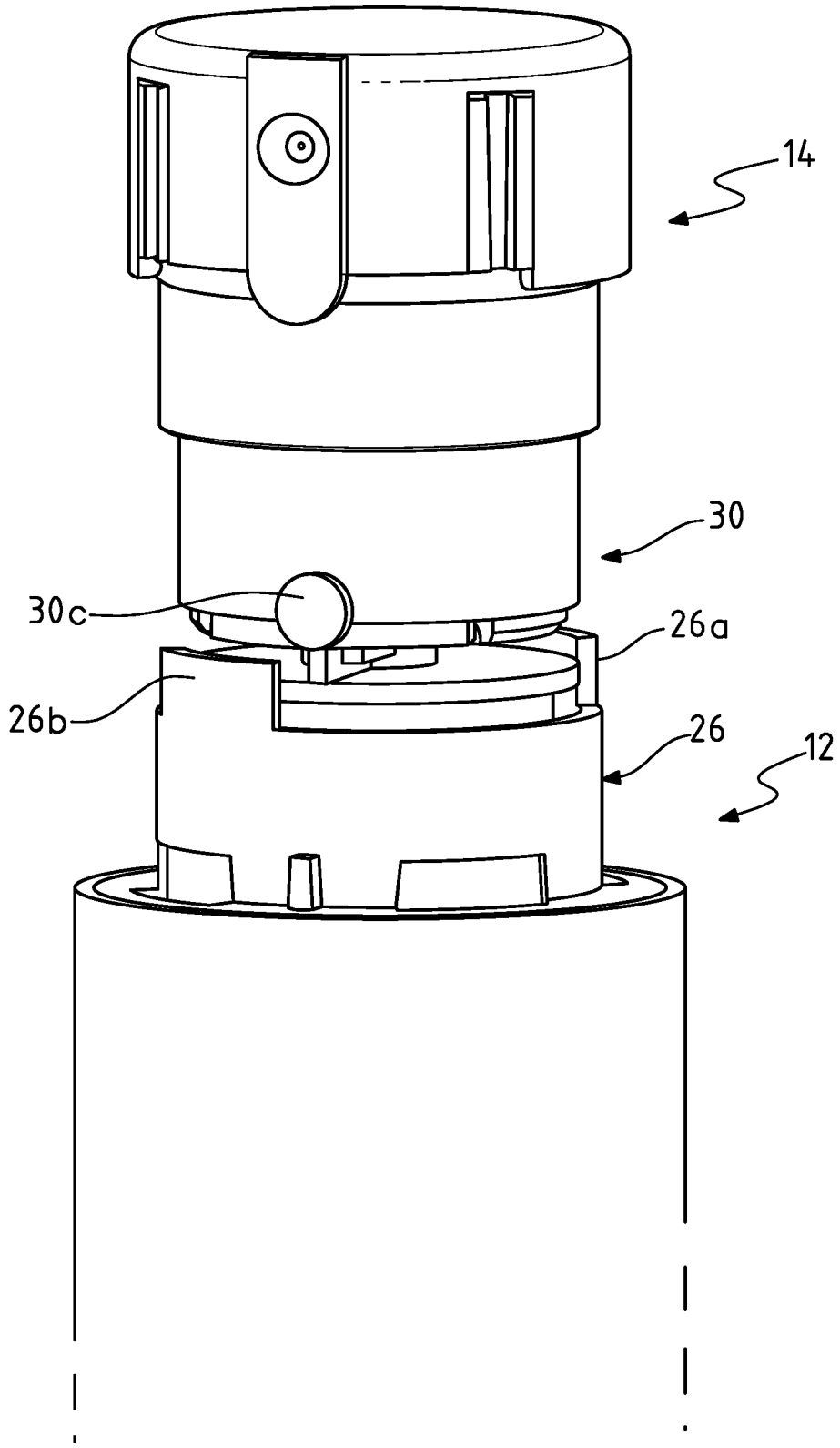
FIG. 6E shows the dispenser in the same position as in FIG. 6D but without either the collar insert 48 or the upper cam 36 so as to highlight the position of the transfer part 30 with respect to the axial stops of the lower cam 26.

The position in FIG. 5B corresponds to an unlocked or unblocked position axially of the dispenser which is obtained as shown in FIGS. 6D and 6E respectively which are analogous to FIGS. 6A and 6C.

More specifically, the second assembly 14 (notably the collar insert 48) is rotated in the anticlockwise direction indicated by the arrow in FIG. 6D, which allows the lug 36*b* to slide inside its cam track 48*b* (it is the cam track that is moved here), over its portion P1, and thus the radial position of the lug 30*c* to be modified with respect to the radial position of the lower axial stop 26*a* so as to be offset radially from said latter as shown in FIG. 6E. By way of example, the rotation is carried out according to an angular sector of approximately 30°. In said position, the lug 36*b* no longer abuts against the bottom of the housing 48*b*1 (FIG. 6D) but still remains blocked/guided in translation inside its cam track and the lug 30*c* is no longer positioned above the axial stop 26*a* of the lower cam 26 but is disengaged from it (FIG. 6E). The same applies to the lug 36*c* in its cam track 48*c* and to the lug 30*d* with respect to the axial stop 26*b*). As a result, the blocking/locking mechanism of the pump is deactivated (release of the pump stroke) and said pump can therefore be actuated by a vertical (axial) external push on a stroke corresponding to the height of the axial stops 26*a-b*.

Figure 5C:
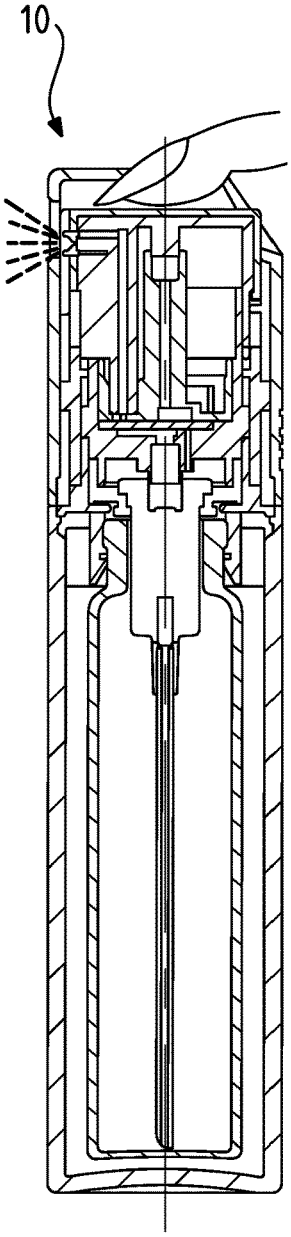
Figure 6F:
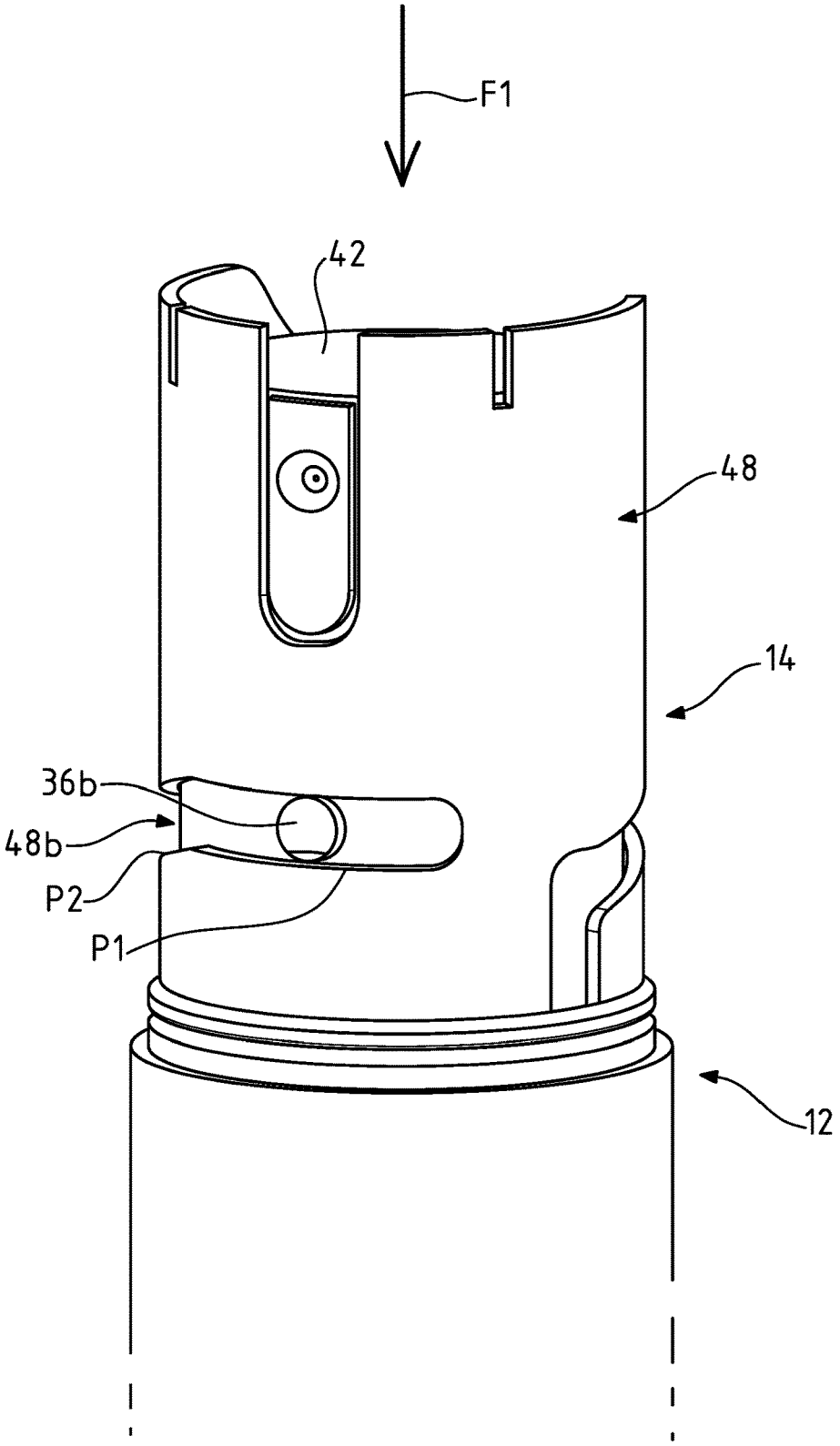
FIG. 6F is a view analogous to that in FIG. 6D, with the dispenser in a position which corresponds to the position in FIG. 5C.
Figure 6G:
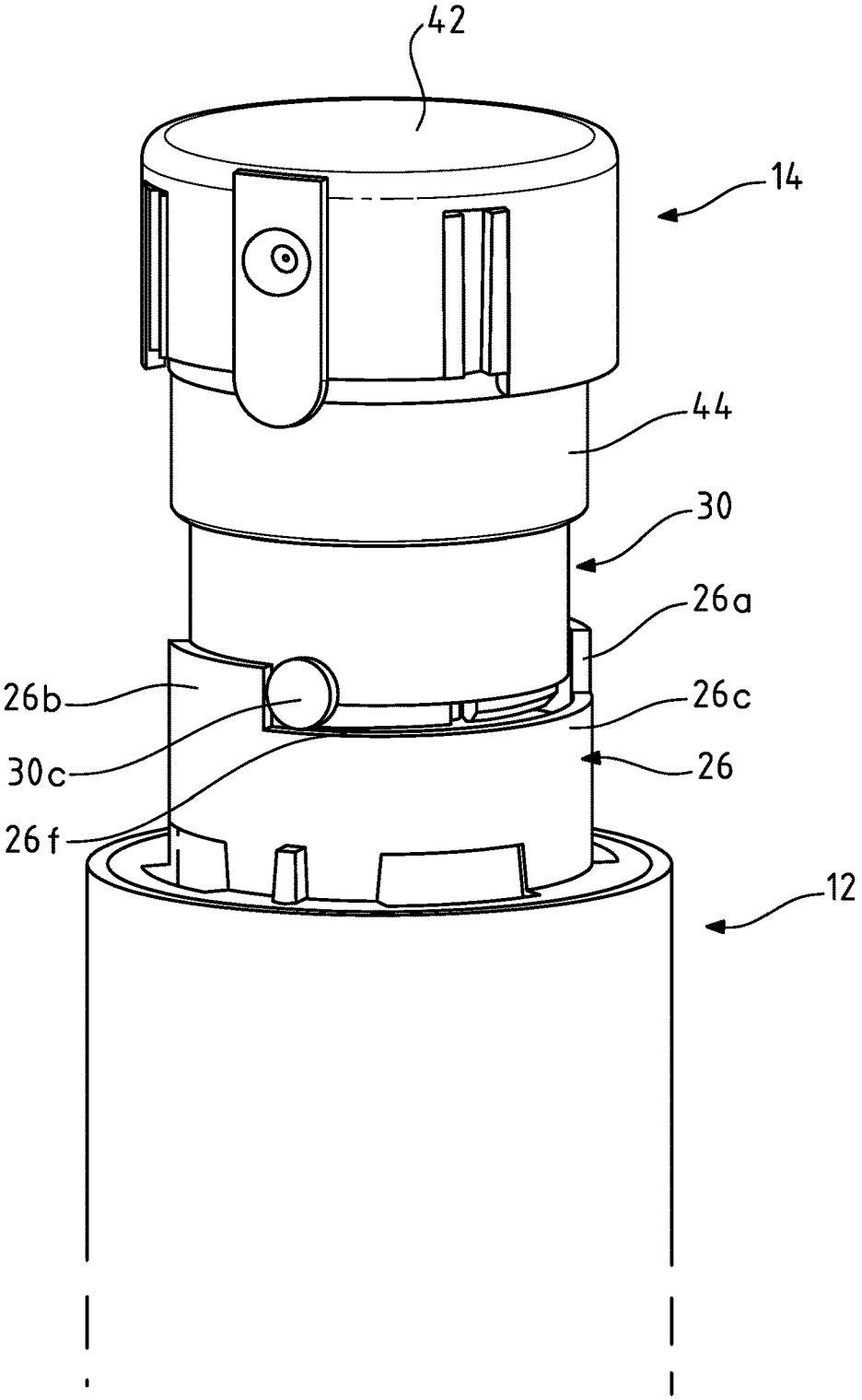
FIG. 6G shows the dispenser in the same position as in FIG. 6F but without either the collar insert 48 or the upper cam 36 so as to highlight the displaced position radially of the member 30*c* with respect to the stop 26*b* of the lower cam 26.

The position in FIG. 5C corresponds to a position of the dispenser in which the pump has been actuated in the lower position by a vertical push by a finger of a user on the device for actuating the dispenser. Said position is obtained as shown in FIGS. 6F and 6G respectively which are analogous to FIGS. 6D and 6E. In said Figures, the pump has been pressed into the lower re-filling position but is no longer blocked in said lower position.

Pressing on the push block, as illustrated by the arrow F1 in FIG. 6F, causes the lug 30*c* to translate axially (as shown in FIG. 3, the push-part abuts against the transfer part 30) along the segment 26*b* of the lower cam 26 (FIGS. 6E and 6G; the same applies to the diametrically opposed lug 30*d*, not visible here, along the segment 26*a*) and therefore the axial actuation of the pump in the lower position whilst the lug 36*b* in FIG. 6F (respectively 36*c*) remains held in the horizontal portion P1 of the cam track 48*b* (respectively 48*c*) because there has not been any rotational movement from the second assembly 14 of the dispenser.

As shown in FIG. 3, the upper cam 36 surrounds the transfer part 30 and includes on its internal surface two internal cam tracks 36*d* and 36*e*, diametrically opposed, arranged respectively above the lugs 30*c* and 30*d* so as to guide said lugs during a relative rotational movement between the two parts 36 and 30. Each internal cam track 36*d*, 36*e* is inclined according to a general form of a portion of a helix so that the axial position of the lug sliding along said cam track descends progressively along the axis of the dispenser. It should be noted that the symmetrical internal cam tracks 36*d*, 36*e* serve to block the pump in the lower re-filling position by preventing the return of said pump (FIGS. 6I and 6J) and also serve for accompanying a gentle return of the pump (the helical form or the helix portion of the cam track assures said gentle return) under the spring pressure of the pump during the unblocking/unlocking operation, with a view to returning to dispensing mode.

During said vertical movement of the push block and of the pump, product is dispensed through the dispensing device described above. Said movement putting the pump in the lower position with a view to re-filling is a regular movement for the user, which does not therefore change his habits. As shown in FIG. 6G, the lug 30*c* rests in abutment against the upper edge 26*f* of the axial wall 26*c* of the lower cam and the same applies to the lug 30*d* which is not visible here.

Figure 5D:
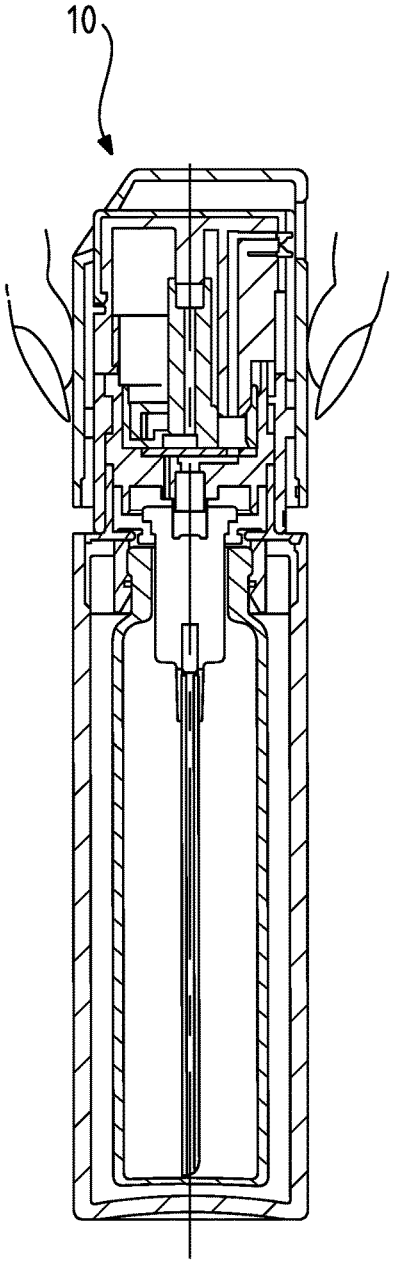

The position in FIG. 5D corresponds to a position of the dispenser in which the pump, which is in the lower position, is going to be blocked/locked and the second assembly 14 is going to be separated from the first assembly 12 of the dispenser. Said position is obtained as shown in FIGS. 6H to 6J.

Figure 6H:
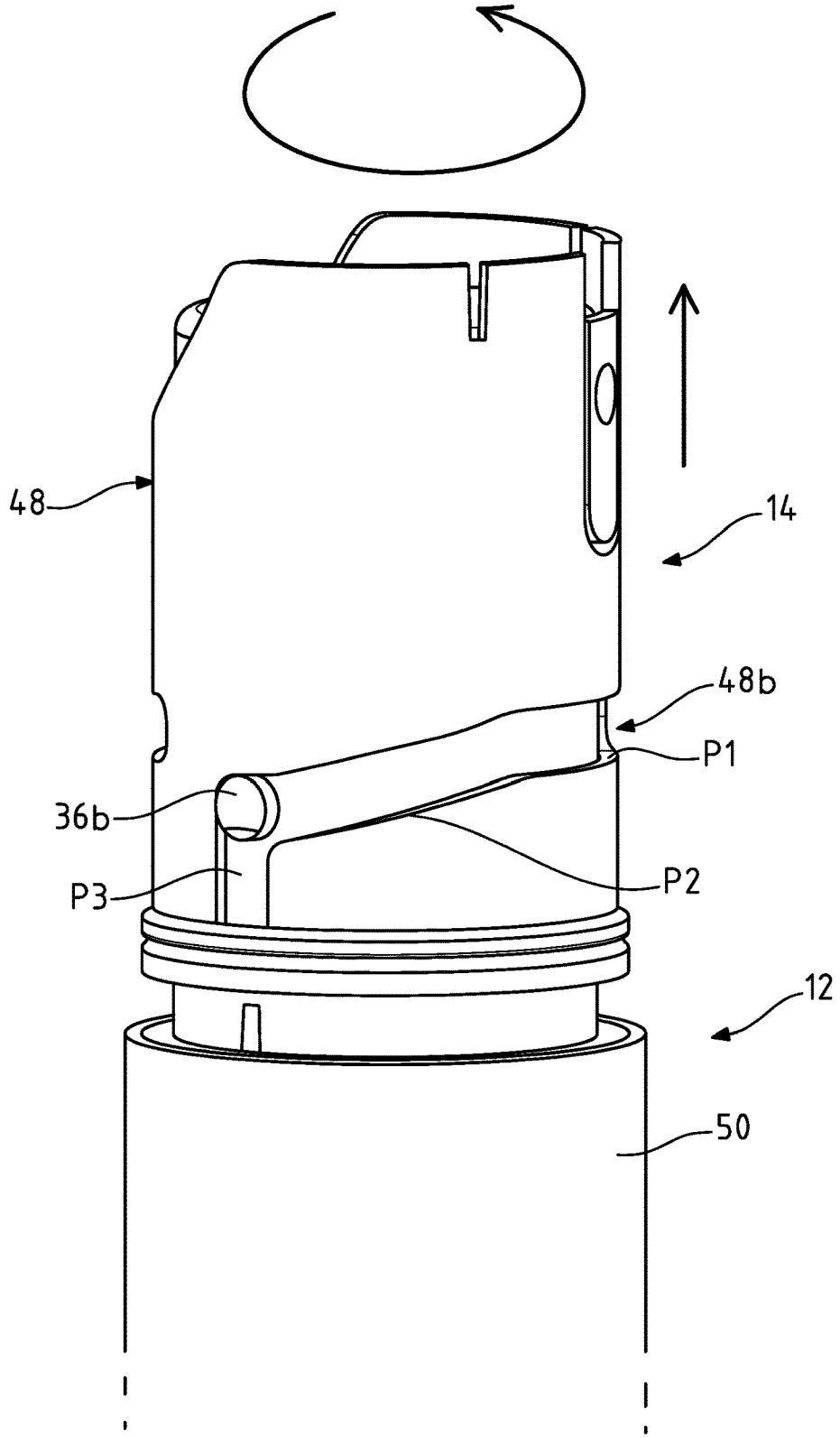
FIG. 6H is a view analogous to that in FIG. 6F, with the dispenser in a position which corresponds to the position in FIG. 5D.

More specifically, the aforesaid position is obtained by rotating the second assembly 14 (notably the collar insert 48) in the anticlockwise direction indicated by the arrow in FIG. 6H so as to make the lug 36*b* slide in the portion P2 of its cam track 48*b* (it is the cam track that is moved here) until it reaches the vertical portion P3 facing the open end of the cam track (the same applies to the lug 36*c* which is moved simultaneously in its corresponding cam track 48*c*). By way of example, the rotation is carried out according to an angular sector of approximately 110°.

During said rotational movement, the descending movement of the lugs 36*b* and 36*c* in their corresponding cam track (or the ascending movement of the cam tracks with respect to the lugs) causes the second assembly 14 to lift as shown by the vertical arrow in FIG. 6H. As will be seen below with reference to the Figures illustrating cross sections of the dispenser, during said rotational and lifting movement, the push block 18, which includes the dispensing device, is unattached/separated axially from the first assembly 12 and notably from the transfer part and from the connector 34.

Figure 6I:
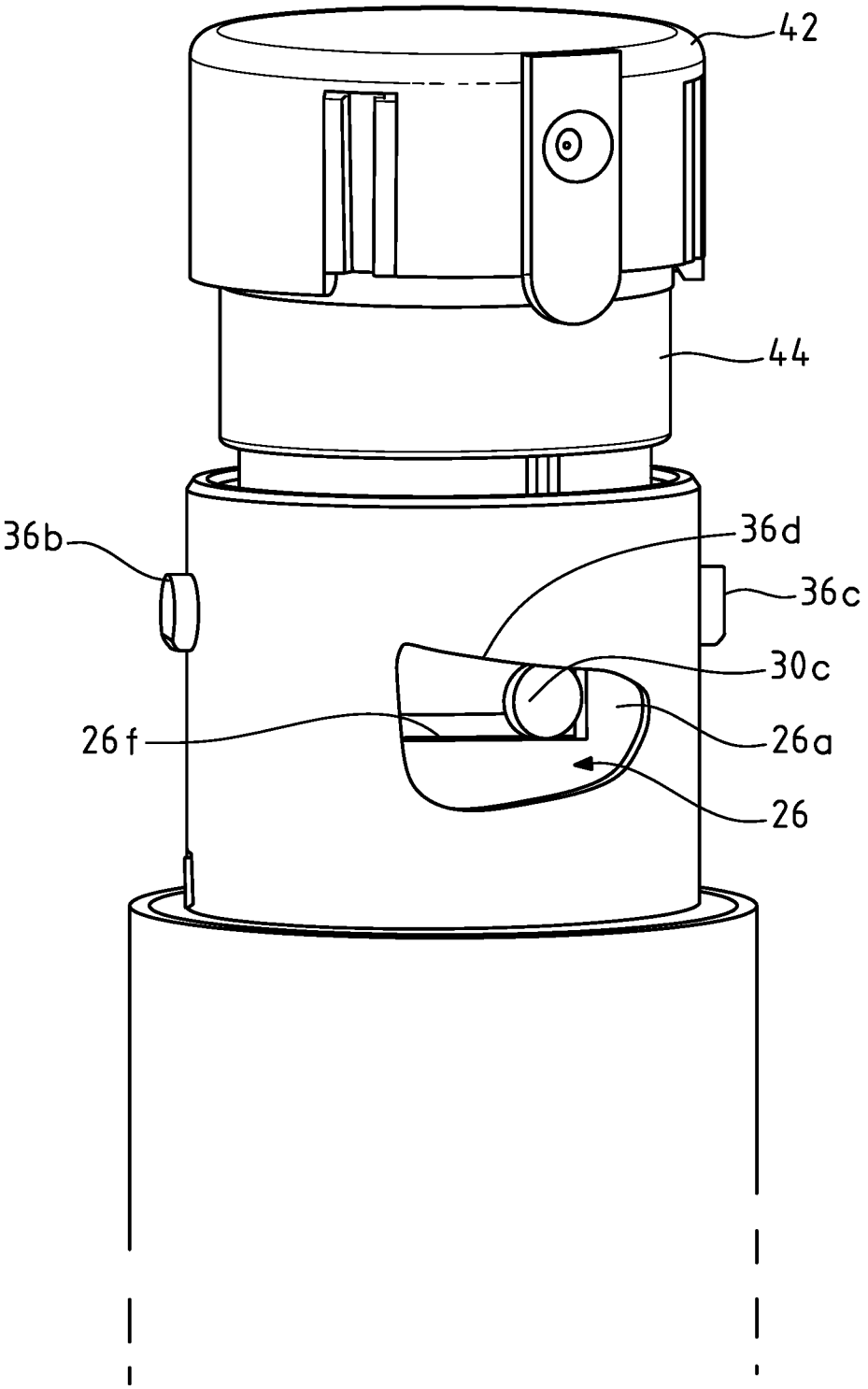
FIG. 6I shows the dispenser in the same position as in FIG. 6H but without the collar insert 48 and with a portion of the upper cam 36 removed so as to highlight in a transparent manner the position of the member 30*c* abutting against the axial stop 26*a* of the lower cam and against the upper stop element 36*d* of the upper cam.
Figure 6J:
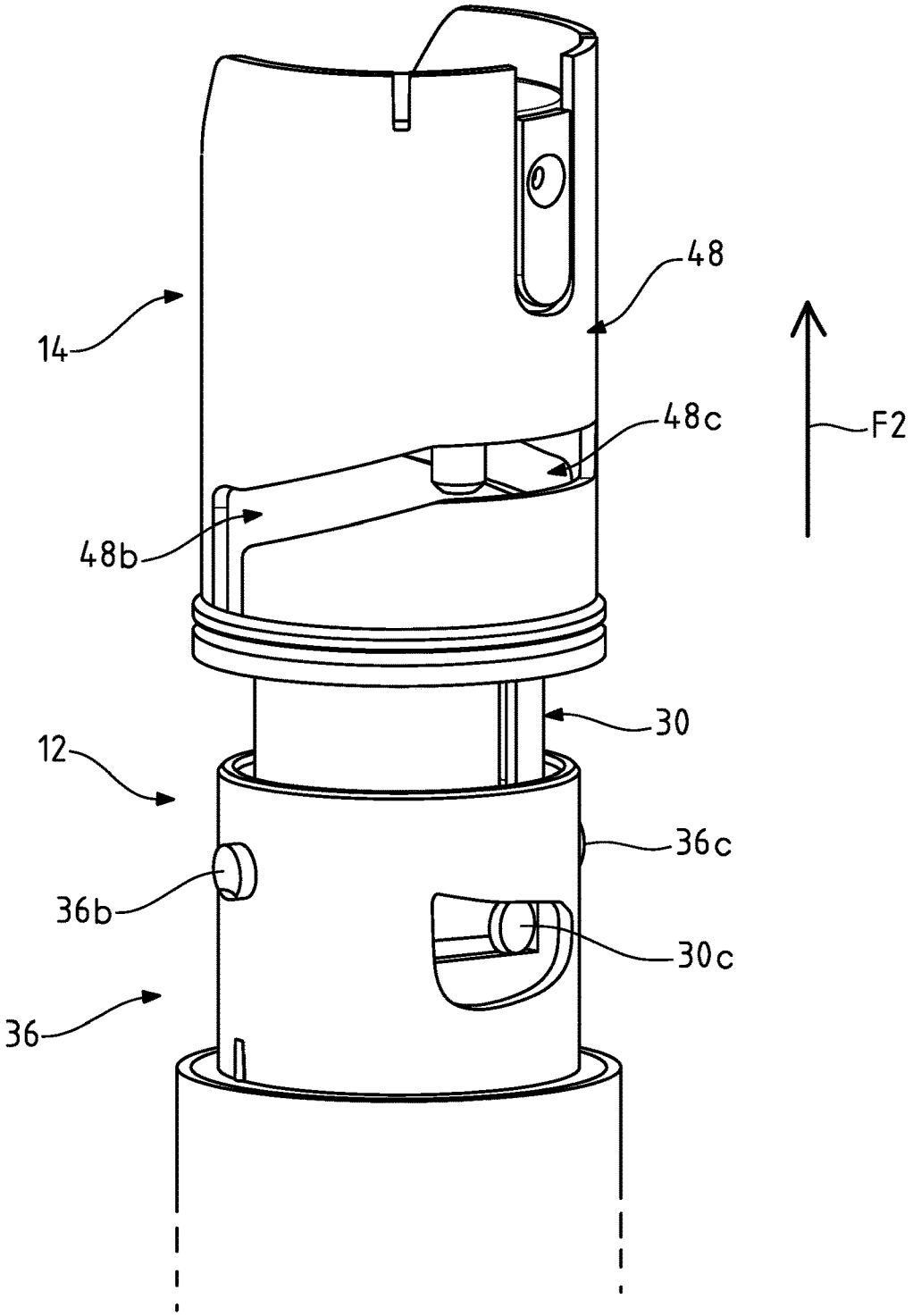
FIG. 6J is a view analogous to that in FIG. 6H, with the dispenser in a position which corresponds to the position in FIG. 5E.

At the same time, the lug 30*c* (respectively the lug 30*d*) of the transfer part 30 is moved along the upper edge 26*f* of the lower cam, whilst being guided above by the corresponding upper internal cam track 36*d* of the upper cam 36 shown in FIGS. 2 and 3 (in FIG. 6I, a fictitious hole has been made in the axial wall of the upper cam 36 so as to show in a transparent manner the position of the lug 30*c* and of its guiding upper internal cam track 36*d* which corresponds here to the upper edge of the fictitious hole). The presence of the upper internal cam track 36*d* (corresponding stop element) prohibits the return of the lug 30*c* (the same applies to the upper internal cam track 36*e* for the lug 30*d*) and therefore of the pump which is partially inserted by its emerging upper end 22*a* into the transfer part 30, as shown in FIG. 3. The pump is thus blocked/locked axially in the lower position, that is to say in a re-filling position. It should be noted that the cam track of the lug 30*c* (respectively of the lug 30*d*) is realized in two parts: the lower cam 26 bearing the lower cam track and the upper cam 36 bearing the upper cam track. The corresponding lug of the transfer part is thus captive inside its cam track. By way of a variant, the cam track of each of the lugs 36*b*, 36*c* can be realized in two parts.

In FIG. 6I, the collar insert 48 has been voluntarily omitted for the sake of visibility and the lug 30*c* is shown in a transparent manner through the fictitious hole (after its guided movement inside its cam track) in position against the axial stop 26*a*. In a corresponding manner, the lug 30*d* is positioned against the corresponding, diametrically opposed, axial stop 26*b*.

Figure 5E:
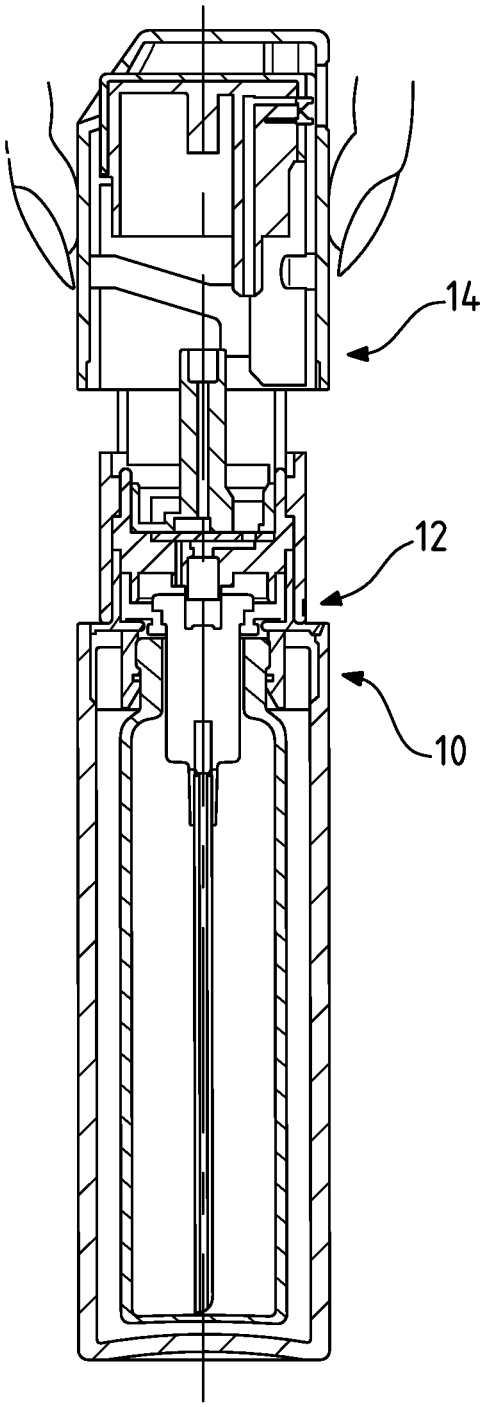
Figure 5F:
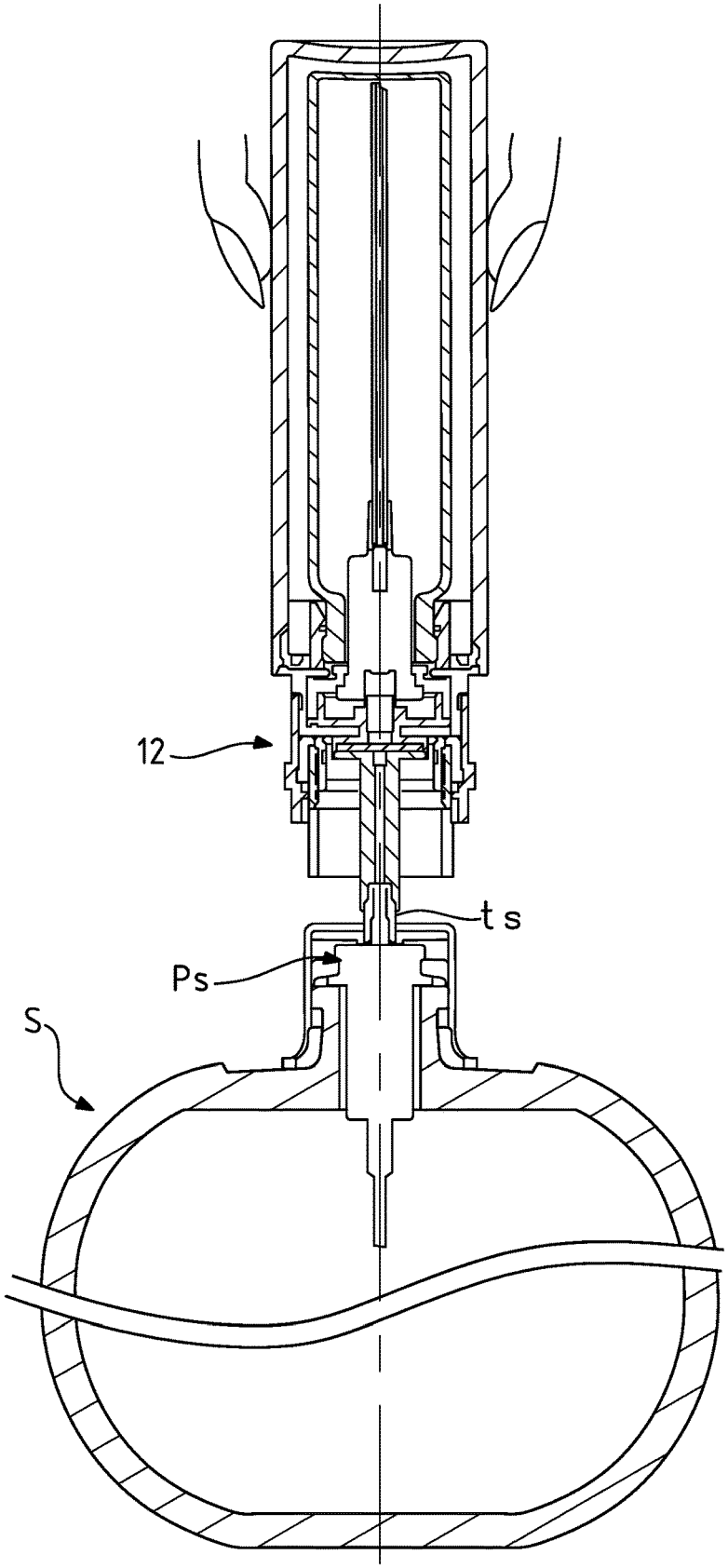
FIG. 5F illustrates the start of the operation for re-filling the bottle with the second assembly 12 in the upturned position.
Figure 5G:
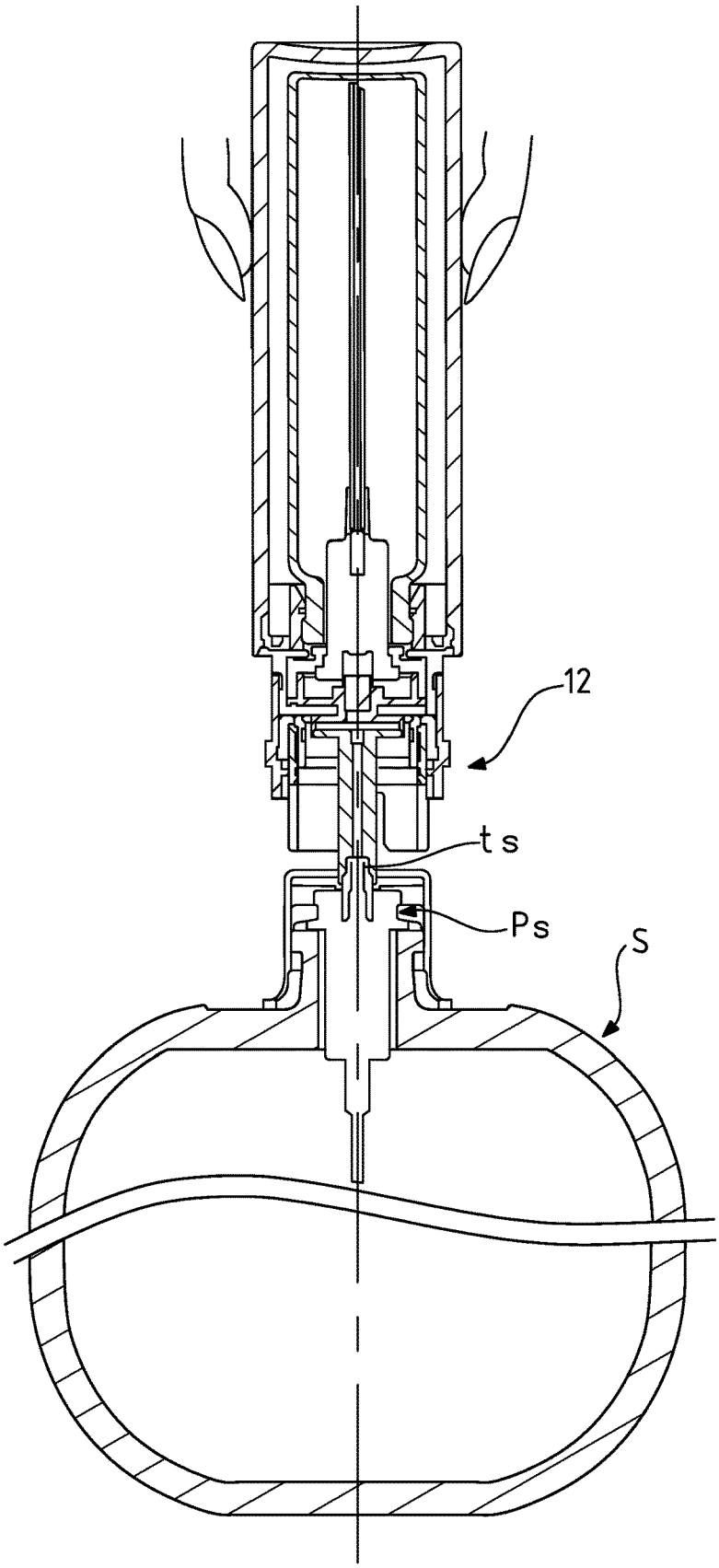
FIG. 5G illustrates the follow-up of the operation for re-filling the bottle during which the source bottle pump is actuated.
Figure 6K:
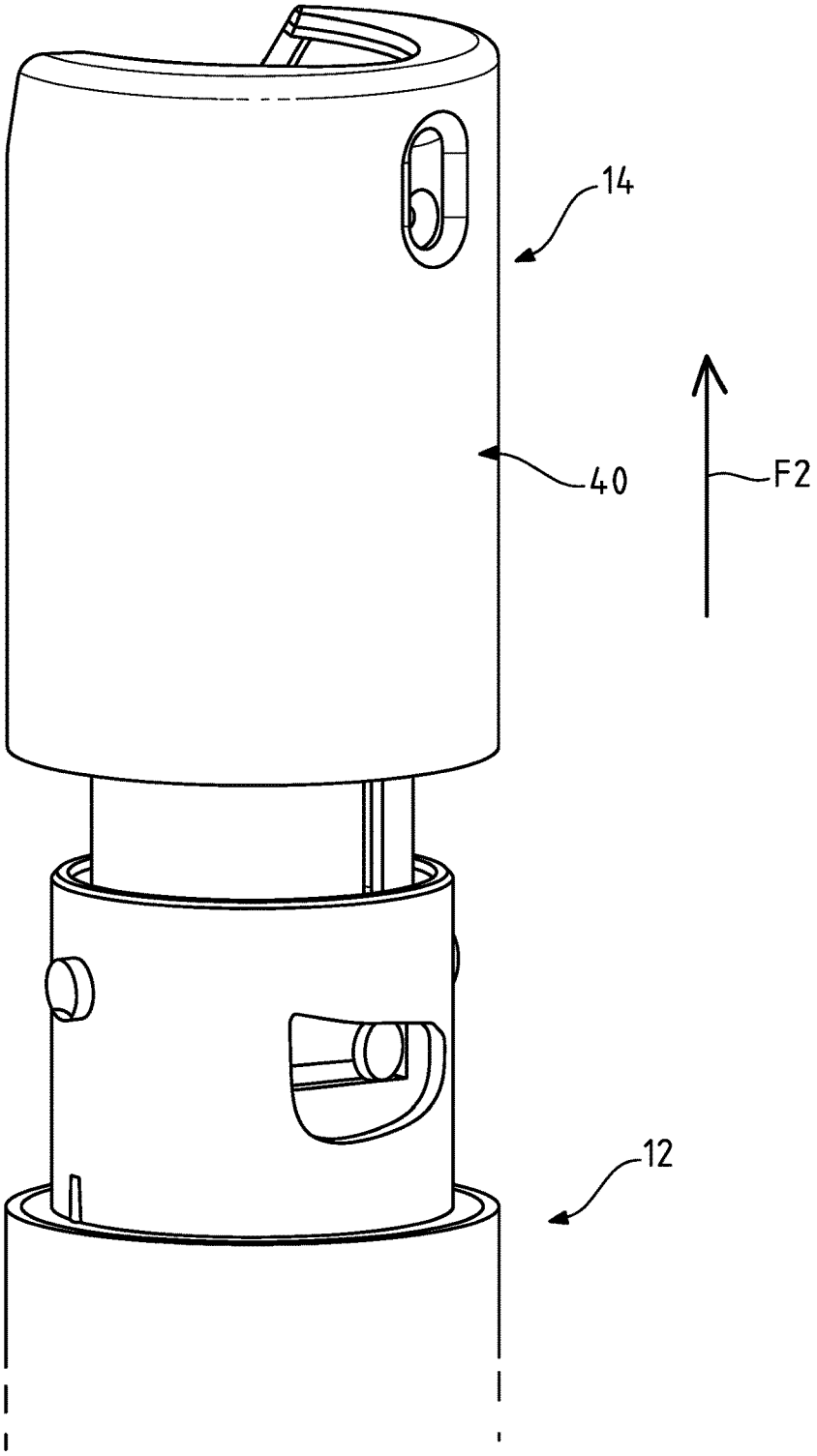
FIG. 6K shows the dispenser in the same position as in FIG. 6J but with the collar 40 over it.

The position in FIG. 5E corresponds to a position of the dispenser in which the two assemblies 12 and 14 are disengaged mechanically from one another, the second assembly 14 being removed axially from the first assembly 12 so as to be separated physically from it, as explained with reference to FIGS. 6J and 6K.

Figure 4:
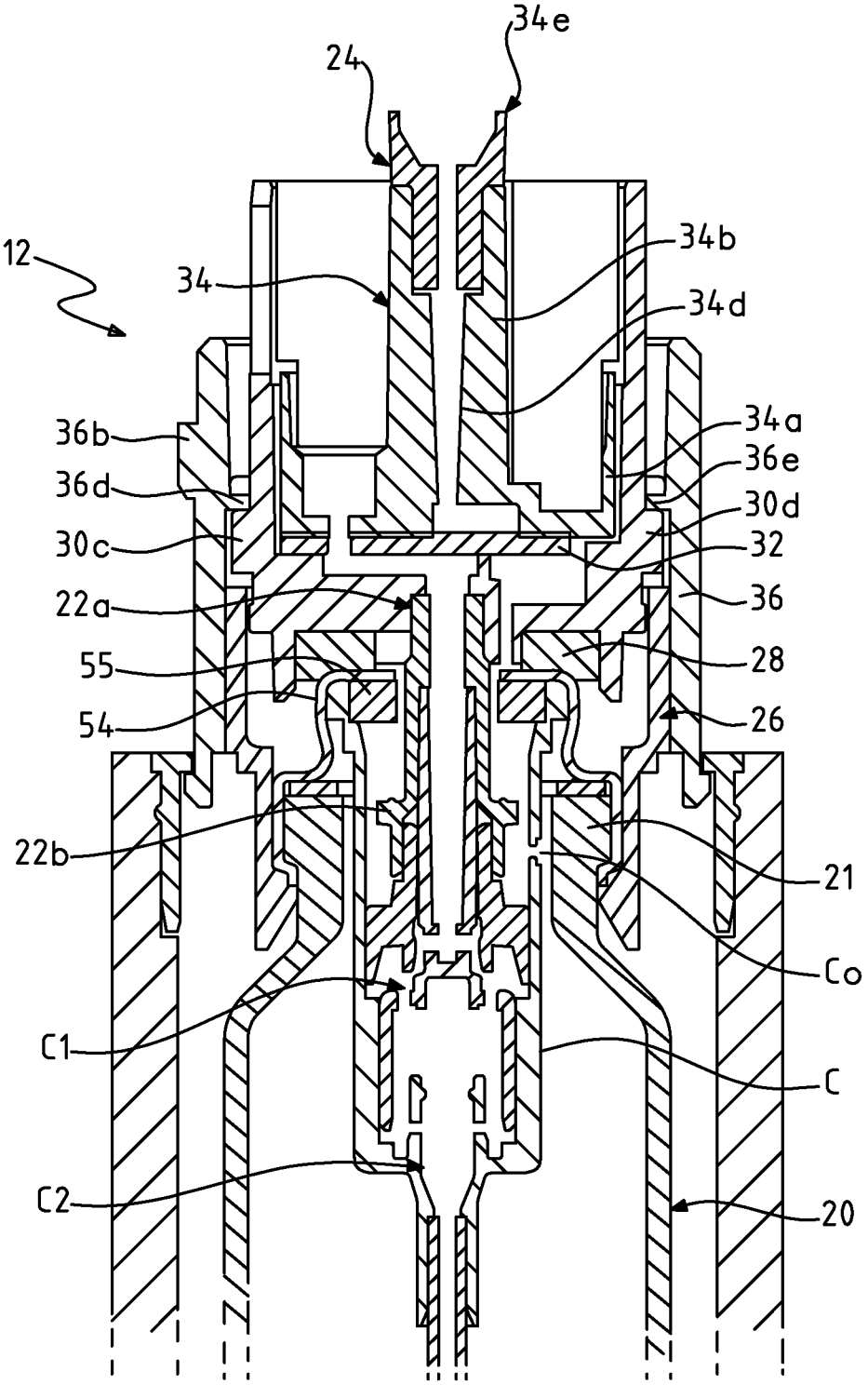
FIG. 4 is a similar view to that in FIG. 3 but with the pump actuated in the lower position and the second assembly 14 removed.

In the position illustrated in FIG. 6H, the lugs 36*b* and 36*c* (this latter cannot be seen in the Figure) are aligned with the vertical portion of their cam track. The second assembly 14 can therefore be lifted axially (the collar insert 48 thus slides axially upward along the upper cam 36) and separated from the first assembly 12, following the movement illustrated by the ascending vertical arrow F2 in FIG. 6J. The lugs 36*b* and 36*c* are thus disengaged axially from the collar insert 48, whilst the lugs 30*c* and 30*d* remain abutting against their upper internal cam track of the upper cam 36, as shown in FIG. 4 where the second assembly has been removed from the dispenser. FIG. 6K shows the same position as FIG. 6J but with the collar 40 as is it normally arranged permanently on the dispenser when the two assemblies are disengaged.

The mechanism or mechanisms which have just been described bring different cam tracks of the lower and upper cams and of the collar insert into play for guiding one or several assembling members (e.g.: lug(s)) of moving parts (upper cam and transfer part) with the aim of positioning and blocking the pump of the dispenser in the lower re-filling position, whilst disengaging/disassembling the second assembly from the dispenser of the first assembly. Other mechanisms allowing said functions to be realized can be used instead of and in place of that or those which have just been described.

Figure 6L:
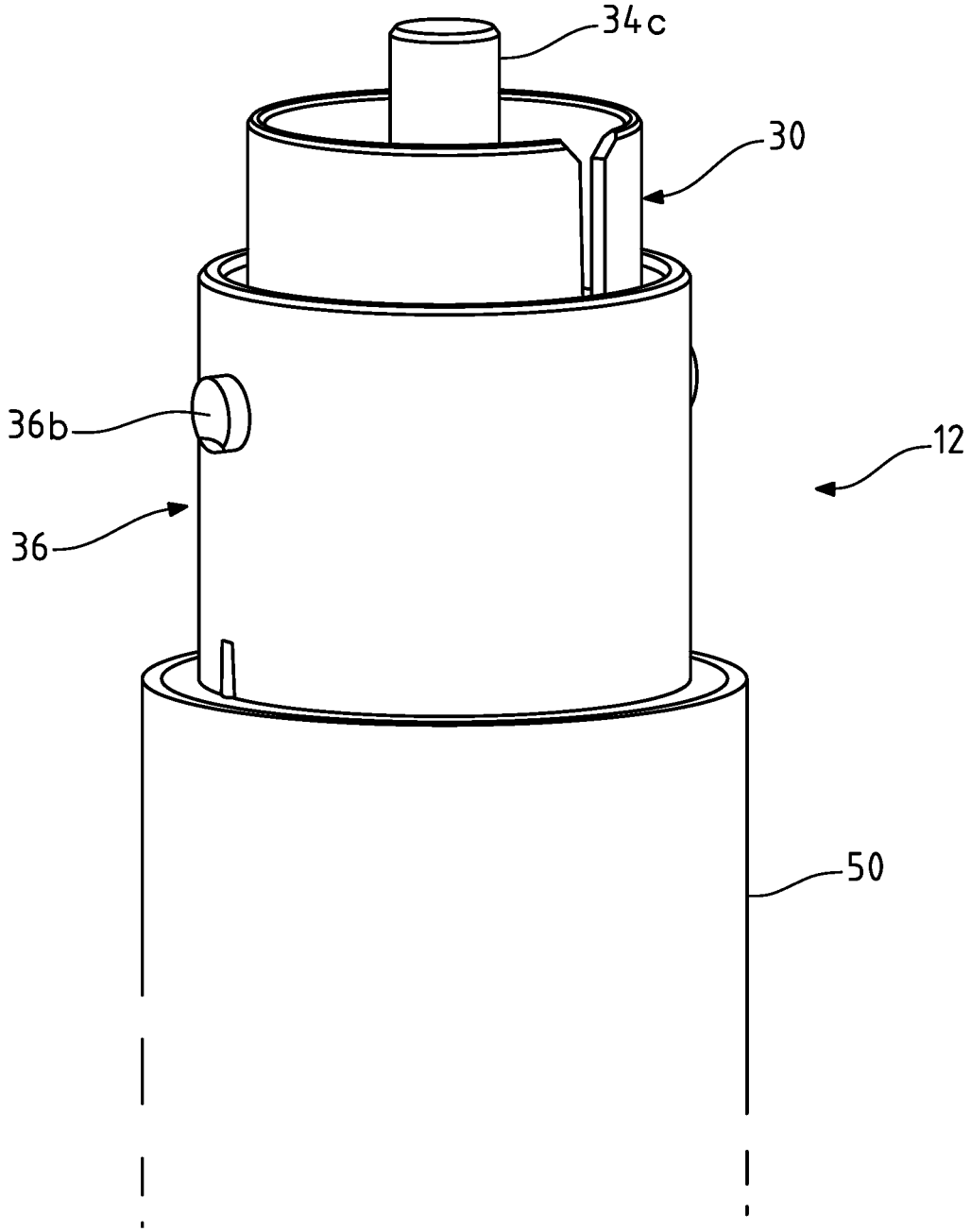
FIG. 6L shows the dispenser of the preceding FIGS. 6A-K where the second assembly 14 has been removed.

FIG. 6L illustrates the remaining part of the travel dispenser 10, specifically the first assembly 12, after having removed the second assembly 14 as explained with reference to the preceding Figures. In said position, the dispenser is ready to be re-filled as will be explained below.

FIGS. 3 and 4 illustrate the arrangement of the different parts inside the dispenser (in cross section) with the pump in the upper position, or the rest position (FIG. 3), and with the pump in the lower position, or the actuated position, after separation of the second assembly 14 and of the first assembly 12 (FIG. 4).

In FIG. 3 the venting passage defined above is closed as the pump is in the upper axial position. In said position, the dispenser does not function but it only takes one vertical push as illustrated in FIG. 1 to actuate the dispensing mode of the dispenser, that is to say to actuate the pump in the lower position and to allow the product to be dispensed. To compensate for the volume of product dispensed to the outside of the dispenser, make-up air penetrates said latter naturally, notably at the level of zone A (FIG. 3) between the over-push-piece 42 and the collar 40, then passes gradually between the collar insert 48 and the push-piece 44, between the upper cam 36 and the transfer part 30 and passes below said latter in order to arrive at the entry opening O into the bottle and then takes the venting passage (opened as a result of the pump being put into the lower position). In said position, the valve C1 of the pump is closed and the lower valve C2 is also closed.

As described above, the transfer seal 32 extends horizontally inside the transfer part 30 and the bottom 34*b* of the connector 34 rests supported above said seal which forms locally a mobile part of said bottom. It should be noted that the seal 32 is shown in a manner partially superimposed on the lower part of the collector 34 in order to show that the seal is compressed in said arrangement.

The bottom of the transfer part 30 is structured inside so as to create two internal zones Z1 and Z2 which are separated from one another in a tight manner by an axial wall p. The zone Z1 communicates, on one side, with the interior of the pump through which the product to be dispensed passes and, on the opposite side, with the passage hole t realized by the geometric matching of two through orifices drilled respectively in the seal 32 and in the bottom 34*b* of the connector. The product leaving the zone Z1 takes the passage hole t and then penetrates into the internal channel 45 of the push-piece 44 so that it can be dispensed through the nozzle 46. The zone Z2 is used during the re-filling of product and forms part of the internal path to the first assembly 12, as the internal channel 34*d*, in order to move the product from the outside to the venting passage of the bottle.

In FIG. 4 the pump is in the lower axial position and the venting passage is therefore open. As shown in said Figure, the part 22*b* of the pump supported against the annular part 55 is removed axially from said latter, thus opening the internal passage to the pump. In the configuration shown in FIG. 4, the cage C, which accommodates the pump 22, includes in its peripheral wall a through orifice Co which allows make-up air (penetrating into the cap and into the pump through the opening O) to leave said cage and to attain the space inside the bottle 20. With the pump in said lower position, the upper valve C1 of the pump is open whilst the lower valve C2 remains closed.

Figure 7:
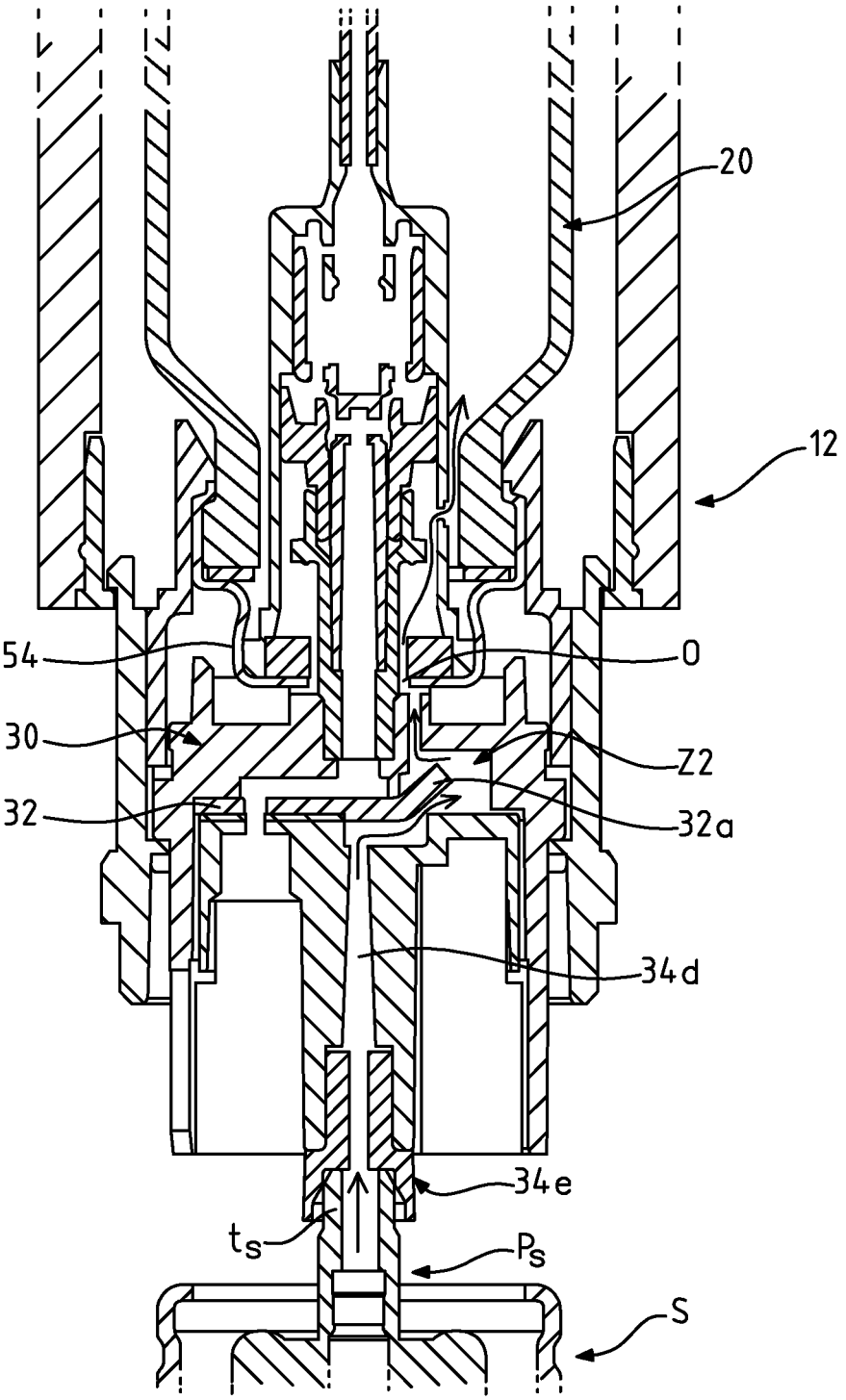
FIG. 7 is a similar view to that in FIG. 4 but with the first assembly 12 in an upturned position and connected to the source bottle as shown in FIG. 5F.

FIGS. 5F and 5G illustrate the re-filling operation, as well as the enlarged partial view in FIG. 7.

In order to proceed with the re-filling of the bottle 20, the first assembly 12 of the dispenser in FIG. 4 is turned upside down, as shown in FIGS. 5F-G and 7, and said assembly is positioned on a pump Ps of a source bottle, the free end of which protrudes outside of the bottle as described above for the bottle to be re-filled. In said position, the valve C2 opens under the effect of gravity. As an alternative to this, in another configuration, the valve (mobile sealing member) could only open with the introduction of product (e.g.: liquid) into the venting passage. According to another configuration, it could already be open in the pre-re-filling position in FIG. 4. More specifically, the first assembly 12 is mounted, for example, by means of its connection part 34*e* which slots on the rod is of the pump Ps to obtain a tight connection. Other alternative mechanical sealing mounting means or devices of the first assembly 12 on the pump Ps of the source bottle are of course conceivable.

In said position, the venting passage of the pump of the first assembly 12 is open as described above with reference to FIG. 4, but the internal path to the first assembly for the re-fill product to flow to the venting passage is closed. Said path only opens when pressurized product penetrates into the interior of said path and locally and temporarily deforms (elastic deformation) the aforesaid blocking member, specifically here a free portion 32*a* of the transfer seal situated adjacently to the zone Z2, as illustrated in FIG. 7.

Re-fill product is suctioned by the user pressing (for example by successive presses) on the first assembly 12 of the dispenser, as shown in FIGS. 5F and 5G. This allows the pump Ps of the source bottle S to be actuated and product to be moved up from the interior of the source bottle to the interior of the bottle 20 as illustrated by the arrows in FIG. 7, successively, by taking the internal channel 34*d*, by traversing the bottom 34*b* of the connector in its locally deformable part which is formed by the deformable portion 32*a* of the transfer seal, by traversing the zone Z2, then the bottom drilled with the transfer part 30, in order finally to penetrate into the cap 54 through its opening O and into the venting passage which leads to the interior of the bottle 20 as explained above.

It should be noted that the method for re-filling a bottle from another bottle, called a source bottle, is broadly described in French patent FR 3 037 577.

The invention claimed is:

1. A travel dispenser comprising:

two assemblies which are connected together mechanically for dispensing product in dispensing mode:

a first assembly including a bottle containing product, a venting passage which is able to be opened in order to connect the interior and the exterior of the bottle and a pump mounted on the bottle which is able to assume, on the one hand, an upper rest position in which the venting passage is closed and, on the other hand, a lower position in which the venting passage is open, the upper and lower positions being considered when the pump is arranged in the upper part of the bottle, a second assembly including a device for dispensing product to the outside of the dispenser, wherein the travel dispenser further comprises:

a first mechanism for blocking the pump which is able to be actuated by means of an external action of a user when the pump is actuated in the lower position, a second mechanism which is configured in order, by means of an external action of a user, to displace the two assemblies with respect to one another from a first position, in which the two assemblies are axially connected, to a second position in which the two assemblies are able to be moved axially apart from one another.

2. The travel dispenser according to claim 1, wherein each mechanism comprises one or multiple blocking members which are each able to cooperate with at least one corresponding stop element in a blocking position, said one or multiple blocking members and said at least one corresponding stop element being able to be displaced in a relative movement with respect to one another by means of an external action of a user, both for attaining the blocking position and for attaining a release position.

3. The travel dispenser according to claim 2, wherein said one or multiple blocking members and said at least one corresponding stop element are different for the two mechanisms.

4. The travel dispenser according to claim 2, wherein said one or multiple blocking members and said at least one corresponding stop element comprise at least one member and at least one corresponding cam track with respect to which said at least one member is able to be moved or the other way round.

5. The travel dispenser according to claim 1, wherein the first assembly includes, on the one hand, a part connected axially and rotatably to the pump and, on the other hand, at least one part, one of the two parts defining a cam track for at least one member of the other part, one of the two parts being connected temporarily to the second assembly so that, following a rotational movement of the second assembly with respect to the first assembly by means of the external action of a user, said at least one member is displaced in a portion of the corresponding cam track which is configured to prevent the pump returning axially in an upper position.

6. The travel dispenser according to claim 1, wherein the first assembly and the second assembly are able to rotate with respect to one another and include two parts one of which is configured to form at least one cam track closed at a first end and open axially at a second opposite end and the other part is configured in order to bear at least one member, said at least one member and said at least one cam track being able to be displaced following a relative rotational movement of one part with respect to the other, said at least one cam track being configured so that, by means of the action of a relative rotational movement provided by a user according to a predetermined angular range, said at least one member is disposed facing the second opposite open end axially of the corresponding cam track, allowing, by means of the action of an axial translation applied by the user, said at least one member to exit from said corresponding cam track and consequently to move the two assemblies apart axially from one another.

7. A method for the re-filling of the travel dispenser as claimed in claim 1, wherein said method comprises the steps of:

blocking of the pump in the lower position; and disengagement of the two assemblies from one another in order to allow the bottle to be re-filled with product through the open venting passage of the first assembly in re-fill mode.

8. The method according to claim 7, wherein the second assembly includes an actuating device which, in dispensing mode, is able, under the effect of an external action, to actuate the pump in the lower position and to open the venting passage so as to allow the product to flow from the bottle to the dispensing device.

9. The method according to claim 8, wherein the actuating device is a push block which is able to receive an external push.

10. The method according to claim 8, wherein the method includes more specifically the following stages:

actuation of the actuating device to actuate the pump in the lower position, actuation of a dispenser blocking mechanism in order to block the pump in the lower position, separation of the first assembly and of the second assembly.

11. The method according to claim 10, said method further includes the following stages:

turning the first assembly upside down, the venting passage of which is open and the pump is blocked in the lower position, positioning of said first assembly on a pump of a source bottle containing product so as to connect the open venting passage of the first assembly mechanically to said pump of the source bottle, actuating the pump of the source bottle so product flows from said source bottle to the bottle to be re-filled through the open venting passage.

12. The method according to one of claim 7, wherein the pump is able to assume several successive lower positions in each of which the venting passage is open.

* * * * *